US011694830B2

(12) United States Patent
Ding

(10) Patent No.: US 11,694,830 B2
(45) Date of Patent: Jul. 4, 2023

(54) FLUX-LEAKAGE MAGNETIC CONDUCTIVE PLATE AND FLUX-LEAKAGE MAGNETIC HOLDING DEVICE

(71) Applicant: SOPH INTERNATIONAL LIMITED, Tortola (VG)

(72) Inventor: Hong Ding, Shanghai (CN)

(73) Assignee: SOPH INTERNATIONAL LIMITED, Tortola (VG)

( * ) Notice: Subject to any disclaimer, the term of this patent is extended or adjusted under 35 U.S.C. 154(b) by 1193 days.

(21) Appl. No.: 16/321,611

(22) PCT Filed: Apr. 28, 2017

(86) PCT No.: PCT/CN2017/082514
§ 371 (c)(1),
(2) Date: Jan. 29, 2019

(87) PCT Pub. No.: WO2018/032800
PCT Pub. Date: Feb. 22, 2018

(65) Prior Publication Data

US 2020/0357551 A1 Nov. 12, 2020

(30) Foreign Application Priority Data

Aug. 15, 2016 (CN) ..... 201620882673.9

(51) Int. Cl.
*H01F 7/02* (2006.01)

(52) U.S. Cl.
CPC ..... *H01F 7/0252* (2013.01)

(58) Field of Classification Search
CPC ..... H01F 7/0252; H01F 7/0257
See application file for complete search history.

(56) References Cited

U.S. PATENT DOCUMENTS 4,090,162 A * 5/1978 Cardone ..... B23Q 3/1546 335/289
7,999,645 B2 * 8/2011 Sarda ..... B23Q 3/1543 335/289

(Continued)

FOREIGN PATENT DOCUMENTS

CN 101544337 A 9/2009
CN 201376830 Y 1/2010

(Continued)

*Primary Examiner* — Mohamad A Musleh
(74) *Attorney, Agent, or Firm* — Price Heneveld LLP

(57) ABSTRACT

A magnetic conductive coverplate of leakage type that may used in magnetic holding devices covers a holding surface of the magnetic holding device. The leakage type magnetic conductive coverplate is made integrally of a single magnetic conductive material. The leakage type magnetic conductive coverplate can conduct magnetic force of the holding device into a workpiece so as to hold it. Because the leakage type magnetic conductive coverplate is made integrally of a single magnetic conductive material, when there is any change in ambient temperature, no crevice will be produced due to different coefficients of expansion and contraction. Therefore, any coolant used in workpiece machining and any magnetic conductive impurities will not infiltrate into or enter the magnetic holding device to lose the internal insulation, thus effectively protecting the internal structure of the magnetic holding device and remarkably improving durability and service life of the magnetic holding device.

18 Claims, 20 Drawing Sheets

(56) References Cited

U.S. PATENT DOCUMENTS

| | | | | |
|---|---|---|---|---|
| 8,031,038 | B2 * | 10/2011 | Kimura | B29C 45/1742 335/289 |
| 9,601,250 | B2 * | 3/2017 | Ding | H01F 7/0252 |
| 2009/0169674 | A1 * | 7/2009 | Kimura | B29C 45/1742 425/595 |

FOREIGN PATENT DOCUMENTS

| | | | | | |
|---|---|---|---|---|---|
| CN | 202102825 | U | * | 1/2012 | H01F 7/0257 |
| CN | 202102825 | U | | 1/2012 | |
| CN | 205959708 | U | | 2/2017 | |
| FR | 2682313 | A1 | * | 4/1993 | B23Q 3/1546 |
| JP | H05262491 | A | * | 10/1993 | |
| JP | 2010538852 | A | * | 12/2010 | |
| JP | 5583015 | B2 | * | 9/2014 | B23P 15/00 |
| WO | WO-2009069146 | A1 | * | 6/2009 | B23Q 3/1546 |
| WO | WO-2009130722 | A1 | * | 10/2009 | B23Q 3/1543 |
| WO | WO-2012100379 | A1 | * | 8/2012 | B23Q 3/1546 |

* cited by examiner

FLUX-LEAKAGE MAGNETIC CONDUCTIVE PLATE AND FLUX-LEAKAGE MAGNETIC HOLDING DEVICE

CROSS-REFERENCE TO FOREIGN PRIORITY APPLICATION

The present application claims the benefit under 35 U.S.C. §§ 119(b), 119(e), 120, 121, and/or 365(c) of PCT/CN2017/082514 filed Feb. 22, 2018, which claims priority to Chinese Application 20162882673U filed Aug. 15, 2016.

FIELD OF THE INVENTION

The present disclosure relates to a kind of magnetic conductive coverplate of leakage type used in magnetic holding devices and a kind of magnetic holding device of leakage type.

BACKGROUND OF THE INVENTION

Magnetic holding devices can be divided into electromagnetic holding device and electric permanent magnetic holding device according to their use of electricity in operation.

An electromagnetic holding device is a holding device, inside which are the iron core and the coil around it. When direct current runs through the coil continuously, magnetic flux is generated by the iron core, and the holding device shows magnetism externally; when current stops, magnetic flux disappears, and the holding device does not show magnetism externally. Most of the current devices are designed without magnetic leakage. This means that utmost use can be made of magnetic force. However, non-magnetic-conductive material must be used between magnetic poles to separate them, to prevent magnetic short-circuit between poles. Usually, the material used is epoxy resin or non-ferrous metals, such as copper. Because the working surface of the holding device is made of two materials, when there is any change in ambient temperature, it is liable to produce crevices due to different coefficients of expansion and contraction, and coolant and other magnetic conductive substances will thus infiltrate into the holding device, to lose internal insulation in the holding device, reducing service life of the holding device.

An electric permanent magnetic holding device is now widely used in the field of mechanical processing as a kind of highly efficient holding method thanks to its advantages of no electric consumption during operation, no thermal deformation, and great holding power. They are divided into two types according to their design of magnetic circuits, with magnetic variation and without magnetic variation. No matter what type is used, it is currently designed without magnetic leakage. This means that utmost use can be made of magnetic force.

The so-called electric permanent magnetic holding device with magnetic variation is the device in which there are two different kinds of magnets to form the circuit. The magnets are generally made from NdFeB with higher coercivity and Alnico with lower coercivity. The direction of the lines of magnetic force of Alnico can be determined by the direction of the current in the external field coil. When the lines of magnetic force of both magnets are in the same direction, magnetism is shown externally. When the lines of magnetic force of the two magnets are in the opposite direction, they are neutralized, and no magnetism is shown externally. However, non-magnetic-conductive material must be used between magnetic poles to separate them, to prevent magnetic short-circuit between poles. Usually the material used is epoxy resin or non-ferrous metals, such as copper. Because the working surface of the holding device is made of two materials, when there is any change in ambient temperature, it is liable to produce crevices due to different coefficients of expansion and contraction, and coolant and other magnetic conductive substances will thus infiltrate into the holding device, to lose internal insulation in the holding device, reducing service life of the holding device.

The so-called electric permanent magnetic holding device without magnetic variation is the device in which there is only one kind of magnet to form the circuit. The magnet is generally made from Alnico with lower coercivity. The direction of the lines of magnetic force of Alnico can be determined by the direction of the current in the external field coil. After the field coil magnetizes Alnico, magnetism is shown externally. After the field coil demagnetizes Alnico oscillatorily, magnetism is not shown externally.

However, non-magnetic-conductive material must be used between magnetic poles to separate them, to prevent magnetic short-circuit between poles. Usually the material used is epoxy resin or non-ferrous metals, such as copper. Because the working surface of the holding device is made of two materials, when there is any change in ambient temperature, it is liable to produce crevices due to different coefficients of expansion and contraction, and coolant and other magnetic conductive substances will thus infiltrate into the holding device, easy to lose internal insulation in the holding device, reducing service life of the holding device.

SUMMARY OF THE INVENTION

In order to solve the above-discussed issues, it is the object of the present disclosure to provide a kind of magnetic conductive coverplate of leakage type used in magnetic holding devices; the magnetic holding device includes a holding surface formed jointly by source magnets and non-magnetic-conductive material; the leakage type magnetic conductive coverplate covers the holding surface of the magnetic holding device; the leakage type magnetic conductive coverplate is made integrally of a single magnetic conductive material.

With such a structure, the leakage type magnetic conductive coverplate can conduct the magnetic force of the holding device into a workpiece so as to hold it. Because the leakage type magnetic conductive coverplate is made integrally of a single magnetic conductive material, when there is any change in ambient temperature, no crevices will be produced due to different coefficients of expansion and contraction. Therefore, the coolant used in workpiece machining and any magnetic conductive impurities will not infiltrate into or enter the holding device from above to lose the internal insulation in the holding device. The leakage type magnetic conductive coverplate covers the holding surface of the magnetic holding device, thus effectively prolonging service life of the holding device.

Preferably, the leakage type magnetic conductive coverplate seals up the holding surface of the magnetic holding device.

Because the leakage type magnetic conductive coverplate covers and seals up the holding surface, the whole leakage type magnetic holding device is in a closed state by means of the leakage type magnetic conductive coverplate, thus effectively protecting the internal structure of the holding device, and greatly improving durability and service life of the holding device.

Furthermore, the leakage type magnetic conductive coverplate contains several magnetic conductive areas and the magnetic leakage area surrounding them, several magnetic conductive areas correspond to the source magnets one to one inside the magnetic holding device, the magnetic leakage area contains the inner grooves set on the inner surface of the leakage type magnetic conductive coverplate and/or the outer grooves set on the outer surface of the leakage type magnetic conductive coverplate.

Preferably, the inner grooves are separated from and opposite to the outer grooves.

Preferably, the depth of the inner grooves is greater than that of the outer grooves.

Furthermore, the leakage type magnetic conductive coverplate coves the magnetic holding device by fixing with a fastening mechanism.

Preferably, the fastening mechanism includes screws, several magnetic conductive areas on the leakage type magnetic conductive coverplate have through holes for inserting the screws.

Preferably, the fastening mechanism includes frame walls set on the edges of the leakage type magnetic conductive coverplate, the frame walls are used to be engaged in the matching structure on the magnetic holding device, thus fixing the leakage type magnetic conductive coverplate onto the magnetic holding device.

The present disclosure provides another kind of magnetic holding device of leakage type, including the base and several source magnets. The base has a bottom and the side walls perpendicular to the bottom, and a cavity having an opening on the top and formed by the bottom and the surrounding side walls. Several source magnets are distributed in the cavity, and lines of magnetic force of the source magnets are conducted outwards from inside the opening. The cavity around the source magnets are filled with non-magnetic-conductive material. The magnetic conductive coverplate as mentioned above is also included.

With such a structure, the leakage type magnetic conductive coverplate can conduct the magnetic force of the holding device into a workpiece so as to hold it. Because the outer surface of the leakage type magnetic conductive coverplate is made integrally of a single magnetic conductive material, when there is any change in ambient temperature, no crevices will be produced due to different coefficients of expansion and contraction. Therefore, the coolant used in workpiece machining and any magnetic conductive impurities will not infiltrate into or enter the holding device from above to lose internal insulation in the holding device, thus effectively prolonging service life of the holding device. Because leakage type magnetic conductive coverplate covers and seals up the holding surface, the whole leakage type magnetic holding device is in a closed state by means of the leakage type magnetic conductive coverplate, thus effectively protecting the internal structure of the holding device, and remarkably improving durability and service life of the holding device.

Furthermore, each of the source magnets includes an iron core and the field coil around it, and the iron core extends from the inner surface of the bottom to the inner surface of the leakage type magnetic conductive coverplate.

Furthermore, each of the source magnets includes a core block on the upper part, a reversible magnet on the lower part and a field coil around the corresponding reversible magnet, the top of the core block presses against the inner surface of the leakage type magnetic conductive coverplate, and the reversible magnet is located between the inner surface of the bottom and the core block.

Preferably, each of the source magnets also includes an irreversible magnet. The irreversible magnet is set between any two core blocks, and between the core block and the inner surface of the side wall.

To sum up, the leakage type magnetic holding device and the leakage type magnetic conductive coverplate of the present utility model use the leakage type magnetic conductive coverplate to cover the holding surface of the holding device. The surface in contact with the workpiece on the leakage type magnetic holding device is formed by a single magnetic conductive material, thus to avoid crevices produced due to different coefficients of expansion and contraction when there is any change in ambient temperature, so that the coolant and other magnetic conductive impurities will not infiltrate into the holding device from above, thus effectively prolonging service life of the holding device with a high value for marketing.

In order to make the above description of the present disclosure more understandable, the preferable embodiments are detailed below with reference to the figures attached:

DETAILED DESCRIPTION OF THE PREFERRED EMBODIMENTS

Embodiment of the present disclosure is described below with specific embodiments. One of ordinary skill in the art can easily understand other advantages and functions of the present disclosure from the contents revealed in this specification. Although the present disclosure will be presented with relatively better embodiments, it does not mean that the present disclosure is limited to these embodiments only. On the contrary, the purpose of presentation of the present disclosure with embodiments is to cover other choices or modifications which may extend from the claims of the present disclosure. In order to provide a deeper understanding of the present disclosure, the description below will include many specific details. The present disclosure can also be embodied without these details. Besides, to avoid confusion or ambiguity in the key points of the present disclosure, some of the details are omitted in the description.

In addition, the words "upper," "lower," "left," "right," "top," and "bottom" used in the description below should not be interpreted as limitation to the present disclosure.

Figure 1A:
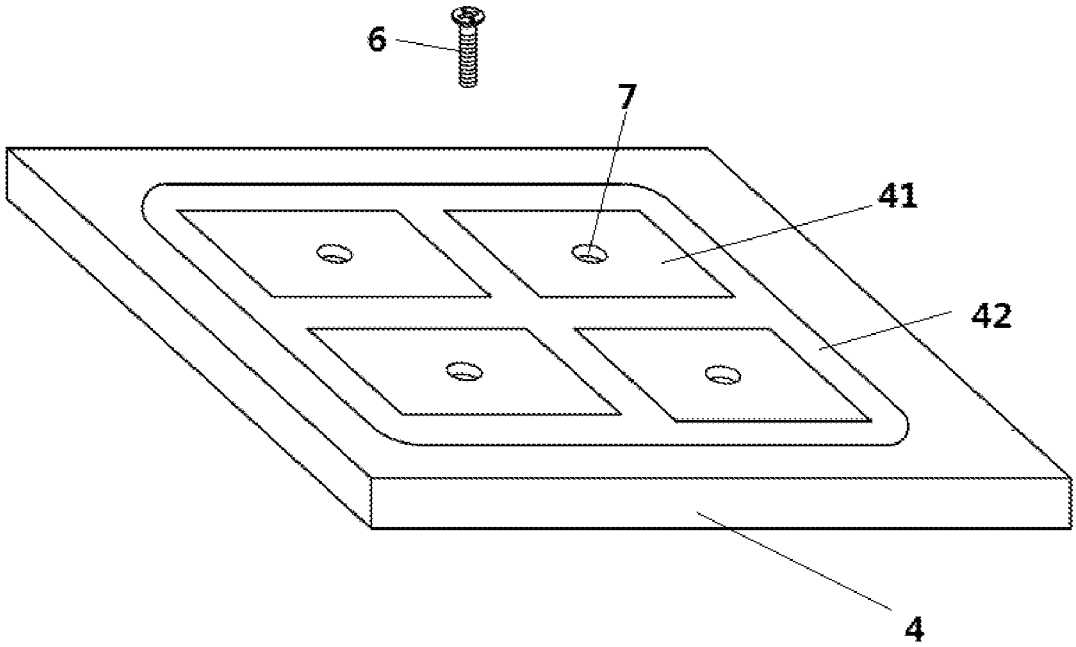
FIG. 1*a* is the overall structure of the leakage type magnetic conductive coverplate based on the first embodiment of the present disclosure.
Figure 1B:
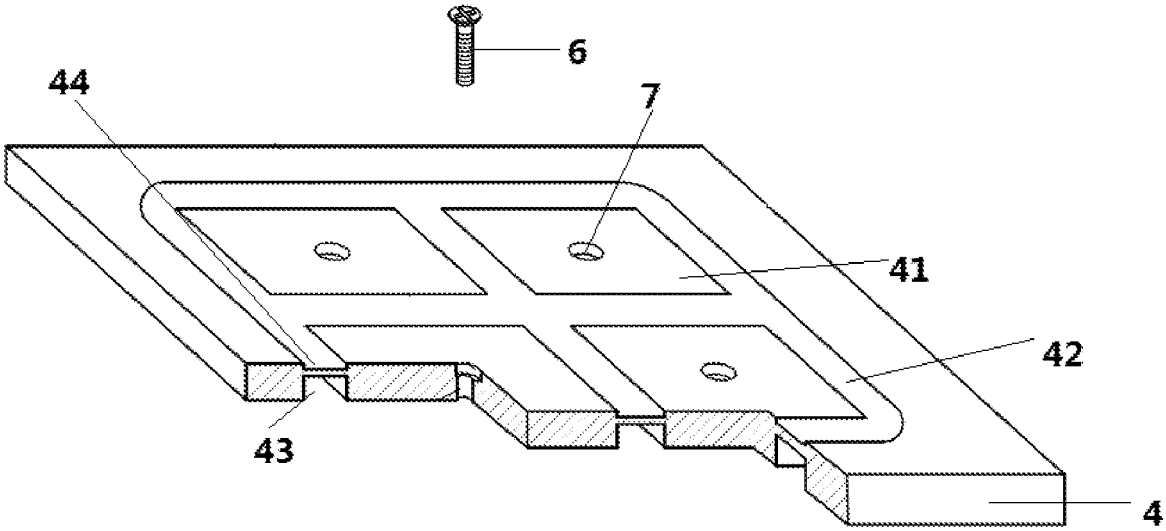
FIG. 1*b* is the three-dimensional broken-out section view of the leakage type magnetic conductive coverplate based on the first embodiment of the present disclosure.
Figure 1C:
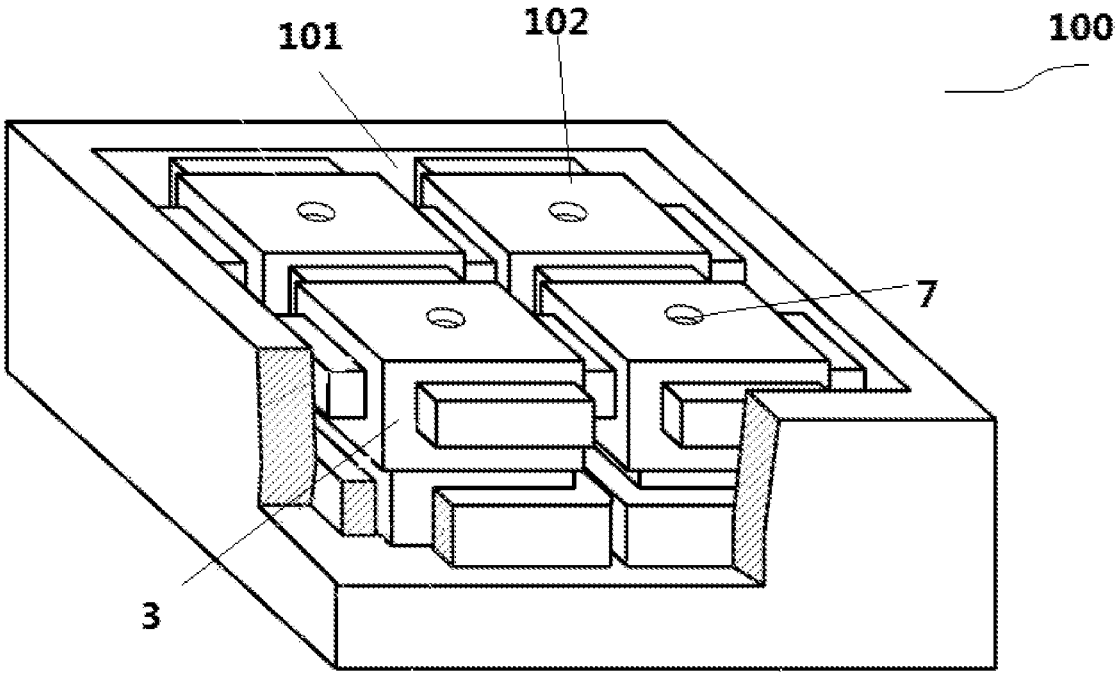
FIG. 1*c* is the three-dimensional broken-out section view of the magnetic holding device based on the first embodiment of the present disclosure.
Figure 1D:
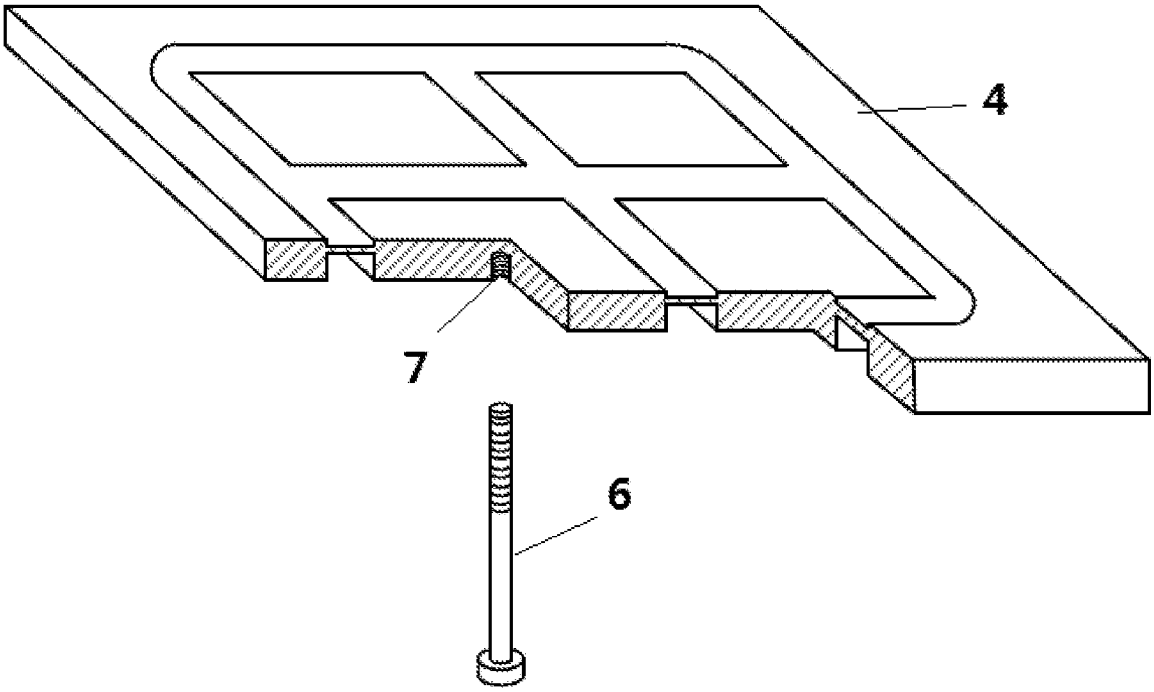
FIG. 1*d* is the three-dimensional broken-out section view of the leakage type magnetic conductive coverplate with the fastening mechanism inserted from the bottom based on the first embodiment of the present disclosure.
Figure 1E:
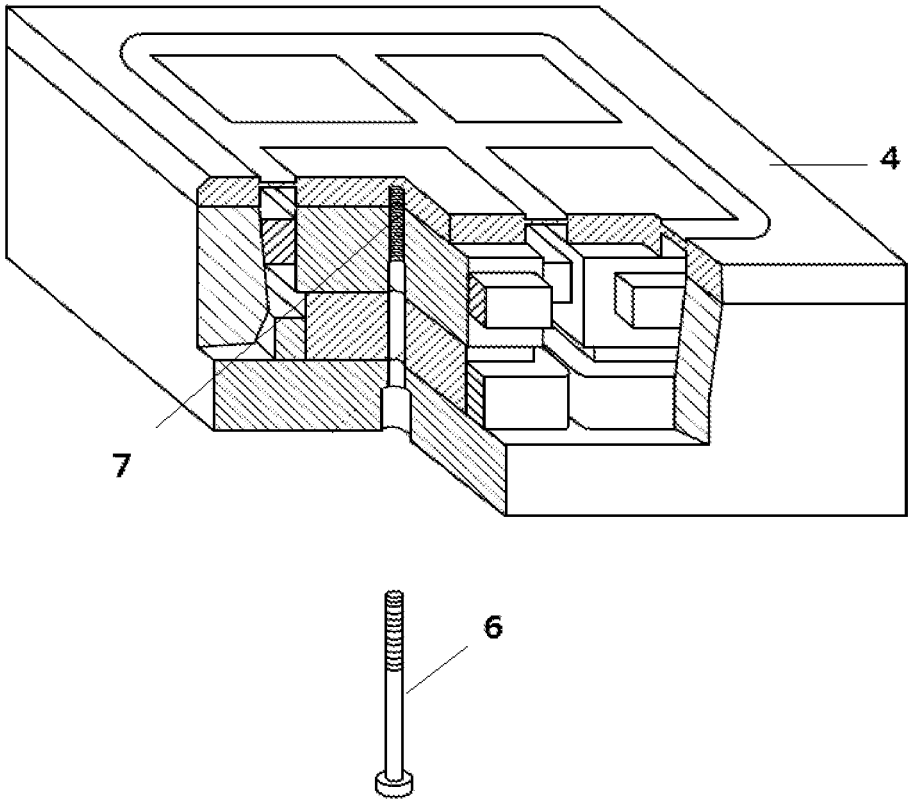
FIG. 1*e* is the three-dimensional broken-out section view of the leakage type magnetic holding device with the fastening mechanism inserted from the bottom based on the first embodiment of the present disclosure.
Figure 1F:
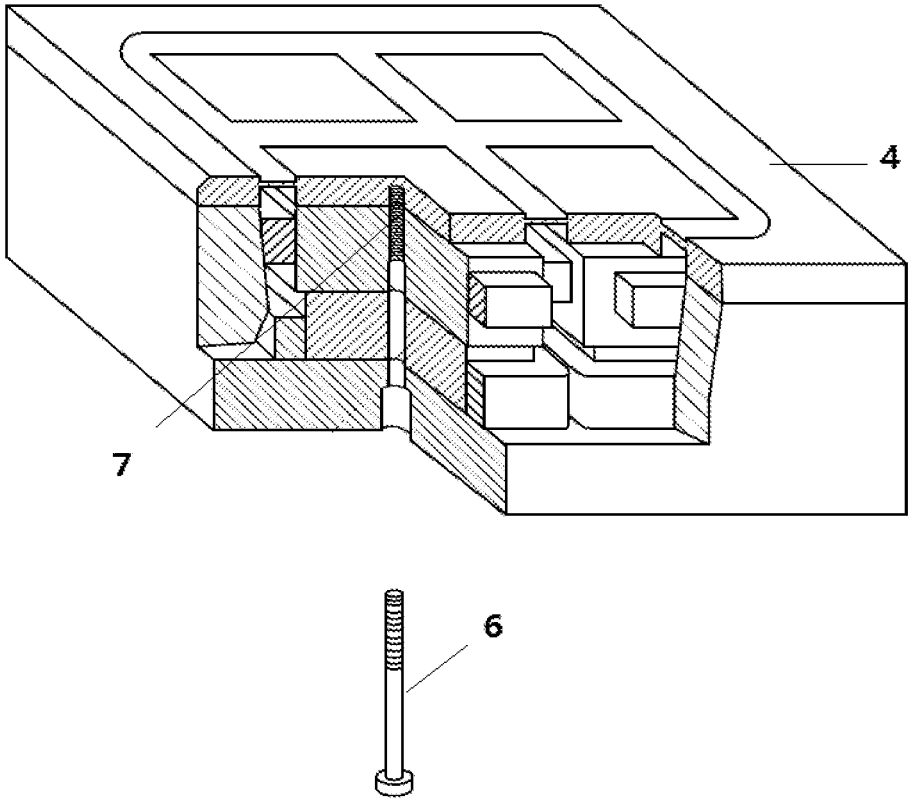
FIG. 1*f* is the three-dimensional broken-out section view of the leakage type magnetic conductive coverplate with frame walls based on the first embodiment of the present disclosure.
Figure 1G:
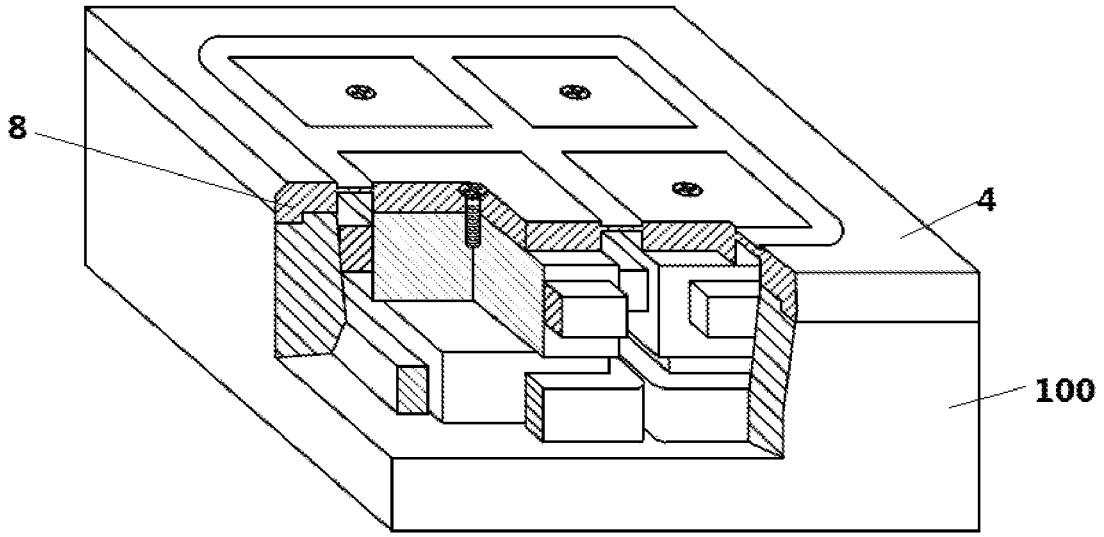
FIG. 1*g* is the three-dimensional broken-out section view of the leakage type magnetic holding device with frame walls based on the first embodiment of the present disclosure.
Figure 1H:
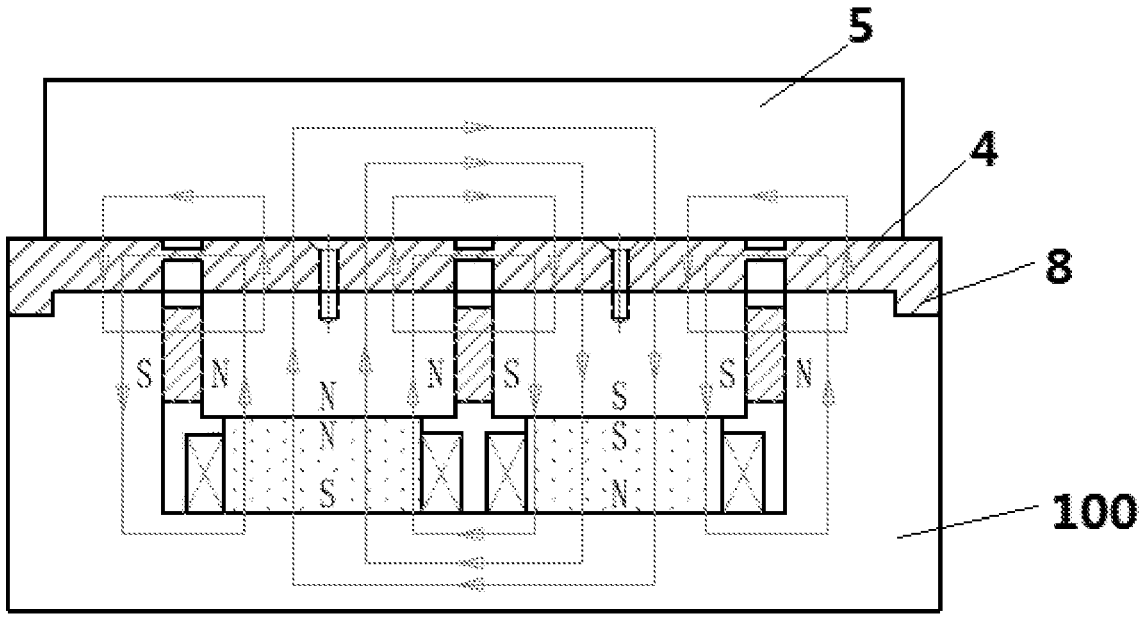
FIG. 1*h* is the section view of the leakage type magnetic holding device with frame walls based on the first embodiment of the present disclosure under excitation condition.

FIG. 1*a* shows the overall structure of the leakage type magnetic conductive coverplate based on the first embodiment of the present disclosure; FIG. 1*b* is the three-dimensional broken-out section view of the leakage type magnetic conductive coverplate based on the first embodiment of the present disclosure; FIG. 1*c* is the three-dimensional broken-out section view of the first embodiment of the magnetic holding device of the present disclosure; FIG. 1*d* is the three-dimensional broken-out section view of the first embodiment of the leakage type magnetic conductive coverplate of the present disclosure with the fastening mechanism inserted from the bottom; FIG. 1*e* is the three-dimensional broken-out section view of the first embodiment of the leakage type magnetic holding device of the present disclosure with the fastening mechanism inserted from the bottom; FIG. 1*f* is the three-dimensional broken-out section view of the first embodiment of the leakage type magnetic conductive coverplate with frame walls of the present disclosure; FIG. 1*g* is the three-dimensional broken-out section view of the first embodiment of the leakage type magnetic holding device with frame walls of the present disclosure; FIG. 1*h* is the section view of the first embodiment of the leakage type magnetic holding device with frame walls of the present disclosure under excitation condition.

As shown in FIGS. 1*a* to 1*c*, the first embodiment of the present disclosure provides a kind of leakage type magnetic conductive coverplate 4 used in a magnetic holding device 100; magnetic holding device 100 includes a holding surface 102 formed jointly by source magnets 3 and a non-magnetic-conductive material 101, a leakage type magnetic conductive coverplate 4 covers the holding surface 102 of the magnetic holding device 100, the leakage type magnetic conductive coverplate 4 is made integrally of a single magnetic conductive material.

Preferably, the leakage type magnetic conductive coverplate 4 is an integral cover plate formed by a single magnetic conductive material, in which, magnetic conductive material is meant by the material of higher magnetic permeability, such as low carbon steel.

Furthermore, the leakage type magnetic conductive coverplate 4 also seals up the holding surface of the magnetic holding device. With such a structure, the whole leakage type magnetic holding device is put in a closed state. The coolant used in workpiece machining and magnetic conductive impurities will not infiltrate into or enter the holding device 100 from the holding surface 102, thus effectively protecting the internal structure of the holding device 100.

In this embodiment, the leakage type magnetic conductive coverplate 4 can be designed into different shapes, such as a triangle or circle, to match the holding device 100. The leakage type magnetic conductive coverplate 4 contains several magnetic conductive areas 41, and the leakage area 42 surrounding the magnetic conductive areas 41; several magnetic conductive areas 41 correspond to several source magnets 3, one-to-one inside the magnetic holding device 100; the leakage area 42 contains inner grooves 43 set on the inner surface of the leakage type magnetic conductive coverplate 4 and/or the outer grooves 44 set on the outer surface of the leakage type magnetic conductive coverplate 4.

More specifically, in the first embodiment of the present disclosure, the non-magnetic-conductive material 101 can be filled in the inner groove 43; or a stainless steel bar can be set in the inner groove 43 to reinforce the leakage type magnetic conductive coverplate 4. The stainless steel bar can be welded in the inner groove 43, or be set in the inner groove 43 by other means, and in the inner groove 43, the stainless steel bar is covered by the non-magnetic-conductive material 101. In the first embodiment of the present disclosure, the inner grooves 43, which surround the magnetic conductive area 41, can be made by milling or other means on the leakage area 42 on the inner surface of the plate-shaped single magnetic conductive material forming leakage type magnetic conductive coverplate 4, and a stainless steel bar is placed in the inner groove 43, then the non-magnetic-conductive material 101 is poured in the inner groove 43 with the stainless steel bar placed inside so that the inner surface of the whole leakage type magnetic conductive coverplate 4 is flattened; or only the non-magnetic conductive material 101 is poured without placing a stainless steel bar. With this method, the magnetic conductive areas 41 corresponding to the source magnets 3 one-to-one, and the leakage area 42 surrounding the magnetic conductive areas 41 can be formed on the leakage type magnetic conductive coverplate 4. More specifically, the non-magnetic-conductive material 101 is epoxy resin.

Alternatively, no material is filled in the inner groove 43 so that the space in the inner groove 43 can be full of the non-magnetic-conductive material when it expands at heat inside the holding device, thus ensuring flatness of the whole holding surface.

Furthermore, the magnetic leakage area 42 also contains outer grooves 44 set on the outer surface of the leakage type magnetic conductive coverplate 4 with or without setting of the inner grooves 43. When both the inner and outer grooves 43, 44 are set, inner groove 43 and outer groove 44 are separated from and opposite to each other, i.e., the leakage area 42 is formed by inner grooves 43 and outer grooves 44 set on the inner and outer surfaces of the leakage type magnetic conductive coverplate 4 and separated from and opposite to each other, between the inner groove 43 and outer groove 44 is a thin interlayer. More specifically, the depth of outer groove 44 can be less than that of the inner groove 43. With such a structure, positions of the magnetic conductive area 41 and the leakage area 42 can be marked on the outer surface of leakage type magnetic conductive coverplate 4 to convenience identification of each area on the leakage type magnetic conductive coverplate 4 by operators from outside. Outer groove 44 in this embodiment is only a structure for marking each area on the leakage type magnetic conductive coverplate 4 from outside. One of ordinary skill in the art should understand that the structure for marking each area on the leakage type magnetic conductive coverplate 4 from outside is not limited to the embodiments enumerated in present disclosure.

Furthermore, leakage type magnetic conductive coverplate 4 is fixed onto the magnetic holding device 100 by means of a fastening mechanism 6. Preferably, the fastening mechanism 6 includes screws. When the screws 6 are inserted from the leakage type magnetic conductive coverplate 4 into the magnetic holding device 100, screw holes 7 for inserting the screws 6 are set in several magnetic conductive areas 41 on the leakage type magnetic conductive coverplate 4. The screw holes 7 can be set separately in the centers of several magnetic conductive areas 41 or other positions good for fixation. The upper part of the screw hole 7 is set in the leakage type magnetic conductive coverplate 4, and the lower part is set in the magnetic holding device 100 to match the upper part. The screw 6 is inserted from the upper part into the lower part of the screw hole 7, thus affixing the leakage type magnetic conductive plate 4 onto the magnetic holding device 100.

Preferably, as shown in FIGS. 1*d* and 1*e*, when the screw 6 is inserted from the bottom of the the magnetic holding device 100 into the leakage type magnetic conductive coverplate 4, in this case, the upper part of screw hole 7 is set in the magnetic holding device 100; accordingly, the lower part of the screw hole 7 is set in the relevant position on the inner surface of the leakage type magnetic conductive coverplate 4. The screw 6 is inserted from the upper part into the lower part of the screw hole 7, so as to affix leakage type magnetic conductive coverplate 4 onto the magnetic holding device 100 from the bottom of the magnetic holding device 100. The fastening mechanism can also be bolts or other elements having the same function.

Preferably, as shown in FIGS. 1*f* to 1*h*, the fastening mechanism also includes frame walls 8 set around the edges of the leakage type magnetic conductive coverplate 4. The frame walls 8 are used to be engaged in the matching structure on magnetic holding device 100, thus affixing the leakage type magnetic conductive coverplate 4 onto magnetic holding device 100. With such a method, not only leakage type magnetic conductive coverplate 4 can be affixed onto the magnetic holding device 100 in an easy way, thus simplifying production and manufacturing processes, but the accuracy of positioning between leakage type magnetic conductive coverplate 4 and the magnetic holding device 100 can also be ensured, thus extending service life and application scope of the whole holding device.

According to the magnetic conductive coverplate 4 of the first embodiment of present disclosure, because the leakage type magnetic conductive coverplate 4 is made integrally of a single magnetic conductive material, and this magnetic conductive coverplate 4 covers the holding surface of holding device 100, when there is any change in ambient temperature, no crevices will be produced due to different coefficients of expansion and contraction. Therefore, the coolant used in processing of workpiece 5 and magnetic conductive impurities will not infiltrate into or enter holding device 100 to lose internal insulation in holding device 100, thus protecting the internal structure of holding device 100 and effectively prolonging service life of holding device 100. Furthermore, the leakage area 42 is of small thickness; therefore, this magnetic leakage has small impact on magnetism shown externally on holding device 100. Such a structure is also advantageous to the magnetic holding device in demagnetization. Remnant magnetism on the surface of leakage type magnetic conductive coverplate 4 is removed by means of a magnetic short-circuit to reduce the effect of remnant magnetism.

Figure 2A:
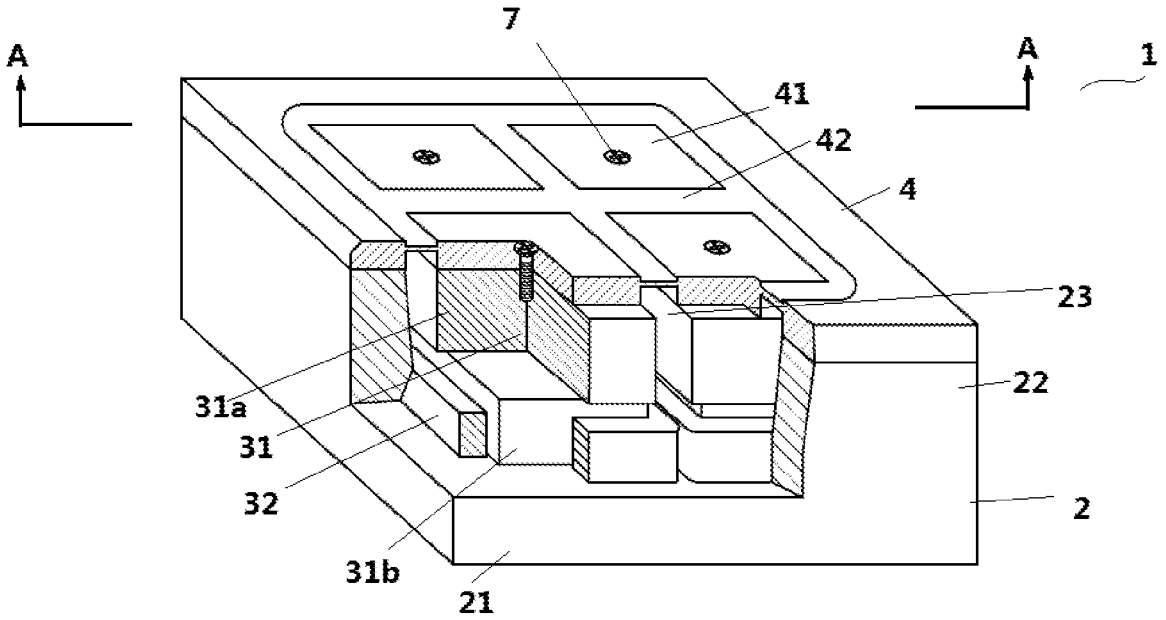
FIG. 2*a* is the three-dimensional broken-out section view of the leakage type magnetic holding device based on the second embodiment of the present disclosure.
Figure 2B:
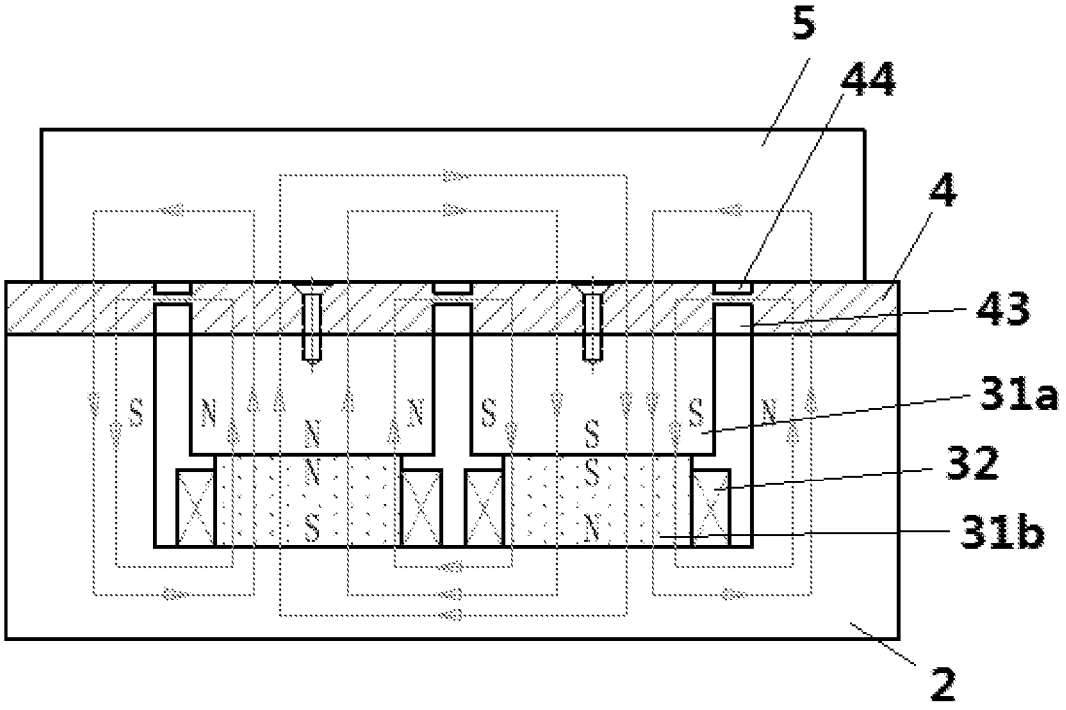
FIG. 2*b* is the section view along line A-A in FIG. 2*a* of the leakage type magnetic holding device based on the second embodiment of the present disclosure under excitation condition.
Figure 2C:
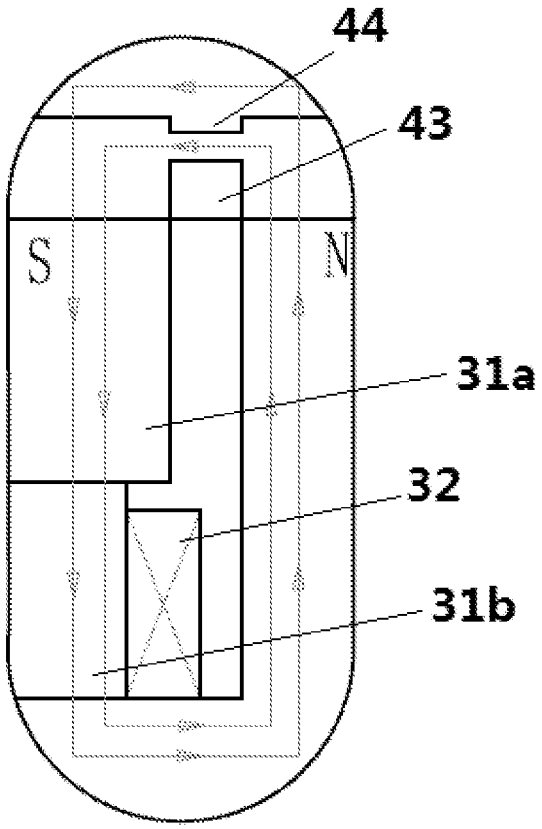
FIG. 2*c* is the partially enlarged view of FIG. 2*b;*
Figure 2D:
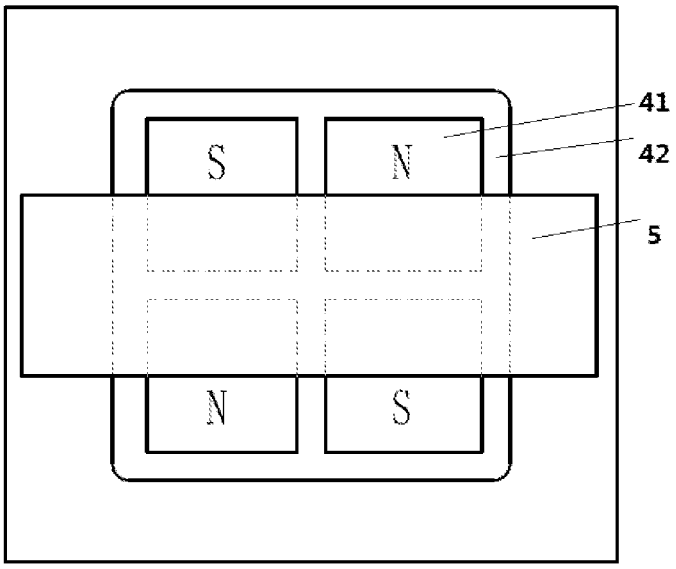
FIG. 2*d* is the top view of the leakage type magnetic holding device based on the second embodiment of the present disclosure under excitation condition.

FIG. 2*a* shows the three-dimensional broken-out section view of the leakage type magnetic holding device 1 based on the second embodiment of the present disclosure; FIG. 2*b* shows the section view along line A-A in FIG. 2*a* of the leakage type magnetic holding device 1 based on the second embodiment of the present disclosure under excitation condition; FIG. 2*c* is the partially enlarged view of FIG. 2*b*; FIG. 2*d* shows the top view of the leakage type magnetic holding device 1 based on the second embodiment of the present disclosure under excitation condition.

Leakage type magnetic holding device 1 based on the second embodiment of present disclosure is a leakage type electric permanent magnetic holding device with no magnetic variation. As shown in FIGS. 2*a* to 2*c*, the leakage type magnetic holding device 1 provided on the basis of the second embodiment of the present disclosure includes: base 2 and several source magnets 3; base 2 has a bottom 21, side walls 22 perpendicular to the bottom, and a cavity 23 having an opening on the top and formed by the bottom 21 and the surrounding side walls 22. Several source magnets 3 are distributed in the cavity 23, lines of magnetic force of source magnets 3 conducted outwards from inside the opening, the cavity around source magnets 3 is filled with magnetic-non-conductive material 101; also includes a leakage type magnetic conductive coverplate 4 covering the opening of cavity 23, the leakage type magnetic conductive coverplate 4 is made integrally of a single magnetic conductive material.

In this embodiment, the leakage type magnetic conductive coverplate 4 is in a rectangular shape, and the outer surface of this leakage type magnetic conductive coverplate 4 is the holding surface of the holding device to hold a workpiece 5 for machining. Source magnets 3 can be evenly distributed in the cavity 23, and their number can be determined with actual needs. In this embodiment, they are set to four. These four source magnets are arranged in two rows and two columns in the cavity 23 on the base 1. However, the number of source magnets 3 in this embodiment is obviously not limited to four, and the shapes of the leakage type magnetic conductive coverplate 4 and the base 1 are not limited to rectangles, and the arrangement of the source magnets 3 in the cavity 23 is not limited to evenly-distributed two rows and two columns.

With such a structure, the leakage type magnetic conductive coverplate 4 can conduct magnetic force of the holding device into workpiece 5 so as to hold it. Furthermore, the leakage type magnetic conductive coverplate 4 also seals up the holding surface of the magnetic holding device. Because the leakage type magnetic conductive coverplate 4 covers the opening of cavity 23, the edges of the leakage type magnetic conductive coverplate 4 are tightly connected with the side walls 22 of the base 1, the whole holding device is thus in a closed state through the leakage type magnetic conductive coverplate 4, effectively protecting the internal structure of the holding device, and remarkably improving durability and service life of the holding device.

More specifically, as shown in FIGS. 2*a* to 2*c*, in the leakage type magnetic holding device provided in this embodiment, the leakage type magnetic conductive coverplate 4 contains several magnetic conductive areas 41 and the leakage area 42 surrounding the magnetic conductive areas 41, the magnetic conductive areas 41 match the source magnets 3 one-to-one in a direction perpendicular to the inner surface of bottom 21. The magnetic conductive areas 41 conduct the magnetic force outwards from inside the holding device, thus forming the magnetic poles to hold the workpiece 5.

More specifically, in the second embodiment of the present utility module, the leakage area 42 of the leakage type magnetic conductive coverplate 4 contains inner grooves 43 set on the inner surface of the leakage type magnetic conductive coverplate 4 and/or the outer grooves 44 set on the outer surface of leakage type magnetic conductive coverplate 4. Non-magnetic-conductive material 101 can be filled in the inner groove 43; or a stainless steel bar can be set in inner groove 43 to reinforce leakage type magnetic conductive coverplate 4. The stainless steel bar can be welded in the inner groove 43, or be set in the inner groove 43 by other means, and in the inner groove 43 the stainless steel bar is covered by the non-magnetic-conductive material 101. In the second embodiment of the present disclosure, the inner groove 43, which surrounds the magnetic conductive area 41, can be made by milling or other means on the inner surface of leakage area 42 on the plate-shaped single magnetic conductive material forming leakage type magnetic conductive coverplate 4, and a stainless steel bar is placed in the inner groove 43, then non-magnetic-conductive material 101 is poured in the inner groove 43 with the stainless steel bar placed inside so that the inner surface of the whole leakage type magnetic conductive coverplate 4 is flattened; or only the non-magnetic-conductive material 101 is poured in the inner groove 43 without placing a stainless steel bar. Preferably, the non-magnetic-conductive material 101 is epoxy resin.

Alternatively, no material is filled in the inner groove 43 so that the space in the inner groove 43 can be full of the non-magnetic-conductive material when it expands at heat inside the holding device, thus ensuring flatness of the whole holding surface.

Furthermore, the magnetic leakage area 42 also contains outer grooves 44 set on the outer surface of the leakage type magnetic conductive coverplate 4 with or without setting of the inner grooves 43. When both the inner and outer grooves 43, 44 are set, the inner groove 43 and the outer groove 44 are separated from and opposite to each other, i.e., the leakage area 42 is formed by the inner groove 43 and the outer groove 44 set on the inner and outer surfaces of the leakage type magnetic conductive coverplate 4 and separated from and opposite to each other, between the inner groove 43 and the outer groove 44 is a thin interlayer. In this embodiment, the depth of the outer groove 44 is less than that of the inner groove 43. With such design, positions of the magnetic conductive area 41 and the leakage area 42 can be marked on the outer surface of the leakage type magnetic conductive coverplate 4 to convenience identification of each area on the leakage type magnetic conductive coverplate 4 by operators from outside. Outer groove 44 in this embodiment is only a structure for marking each area on the leakage type magnetic conductive coverplate 4 from outside. One of ordinary skill in the art should understand that the structure for marking each area on the leakage type magnetic conductive coverplate 4 from outside is not limited to the embodiments enumerated in the present disclosure.

More specifically, in the second embodiment of the present disclosure, each source magnet 3 contains a core block 31*a* on the upper part, a reversible magnet 31*b* on the lower part, and a field coil 32 around a reversible magnet 3*b* corresponding to it, one-to-one; the top of core block 31*a* presses against the inner surface of the leakage type magnetic conductive coverplate 4, the reversible magnet 31*b* is located between the inner surface of the bottom and the core block 31*a*. Magnetic material, such as Alnico, can be chosen for the reversible magnet 31*b*. As shown in FIG. 2*b*, the reversible magnet 31*b* is set in each core block 31*a* in several source magnets 3 just below and pressing against the core block 31*a*. When instantaneous current runs through the field coil 32, the reversible magnet 31*b* is excited, polarity N-S is exhibited from top to bottom; when the adjacent reversible magnet 31*b* is excited, polarity is S-N from top to bottom, thus a magnetic circuit, as shown in FIG. 2*b*, is formed among the reversible magnet 31*b*, the adjacent reversible magnet 31*b*, the core block 31*a*, the leakage type magnetic conductive coverplate 4, the base 2, and a workpiece 5. In this way, the magnetic holding device 1 shows magnetism externally, holding the workpiece 5 to be processed onto the outer surface of the leakage type magnetic conductive coverplate 4.

In the case that holding needs to be released, the current with gradually attenuating oscillation runs through the field coil 32, the reversible magnet 31*b* is demagnetized gradually, so that the leakage type magnetic holding device 100 does not show magnetism externally, holding of the workpiece 5 on the outer surface of leakage type magnetic conductive coverplate 4 is released.

Furthermore, the leakage type magnetic conductive coverplate 4 is fixed onto the magnetic holding device 100 by means of fastening mechanism 6. Preferably, fastening mechanism 6 includes screws. When screws 6 are inserted from the leakage type magnetic conductive coverplate 4 into magnetic holding device 100, screw holes 7 for inserting the screws 6 are set in several magnetic conductive areas 41 on the leakage type magnetic conductive coverplate 4. Screw holes 7 can be set separately in the centers of several magnetic conductive areas 41 or other positions good for fixation. The upper part of screw hole 7 is set in the leakage type magnetic conductive coverplate 4, and the lower part is set in the magnetic holding device 100 to match the upper part. The screw 6 is inserted from the upper part into the lower part of the screw hole 7, thus fixing the leakage type magnetic conductive plate 4 onto the magnetic holding device 100.

Preferably, as shown in FIGS. 1*d* and 1*e*, when the screw 6 is inserted from the bottom of the the magnetic holding device 100 into the leakage type magnetic conductive coverplate 4, in this case, the upper part of the screw hole 7 is set in the magnetic holding device 100, accordingly, the lower part of the screw hole 7 is set in the relevant position on the inner surface of the leakage type magnetic conductive coverplate 4. The screw 6 is inserted from the upper part into the lower part of screw hole 7, so as to fix the leakage type magnetic conductive coverplate 4 onto the magnetic holding device 100 from the bottom of the magnetic holding device 100. The fastening mechanism can also be bolts or other elements having the same function.

Preferably, as shown in FIGS. 1*g* to 1*h*, the fastening mechanism also includes frame walls 8 set around the edges of leakage type magnetic conductive coverplate 4. The frame walls 8 are used to be engaged in the matching structure on the magnetic holding device 100, thus affixing the leakage type magnetic conductive coverplate 4 onto the magnetic holding device 100. With such a method, not only the leakage type magnetic conductive coverplate 4 can be affixed onto the base 2 in an easy way, thus simplifying production and manufacturing processes, but the accuracy of positioning between the leakage type magnetic conductive coverplate 4 and the base 2 can also be ensured, thus extending service life and application scope of the whole holding device.

According to the leakage type magnetic holding device 1 of the second embodiment of the present disclosure, because the leakage type magnetic conductive coverplate 4 is made integrally of a single magnetic conductive material, and this magnetic conductive coverplate 4 covers the opening of the cavity 23 in the base 2, when there is any change in the ambient temperature, no crevices will be produced due to different coefficients of expansion and contraction. Therefore, the coolant used in processing of the workpiece 5 and the magnetic conductive impurities will not infiltrate into or enter the leakage type magnetic holding device 1 to lose internal insulation in the leakage type magnetic holding device 1, thus protecting the internal structure of the holding device 100 and effectively prolonging service life of the leakage type magnetic holding device 1. Furthermore, the leakage area 42 is of small thickness, therefore, this the magnetic leakage 42 has small impact on magnetism shown externally on the leakage type magnetic holding device 1. Such a structure is also advantageous to the the magnetic holding device in demagnetization. Remnant magnetism on the surface of the leakage type magnetic conductive coverplate 4 is removed by means of magnetic short-circuit to reduce the effect of remnant magnetism.

Figure 3A:
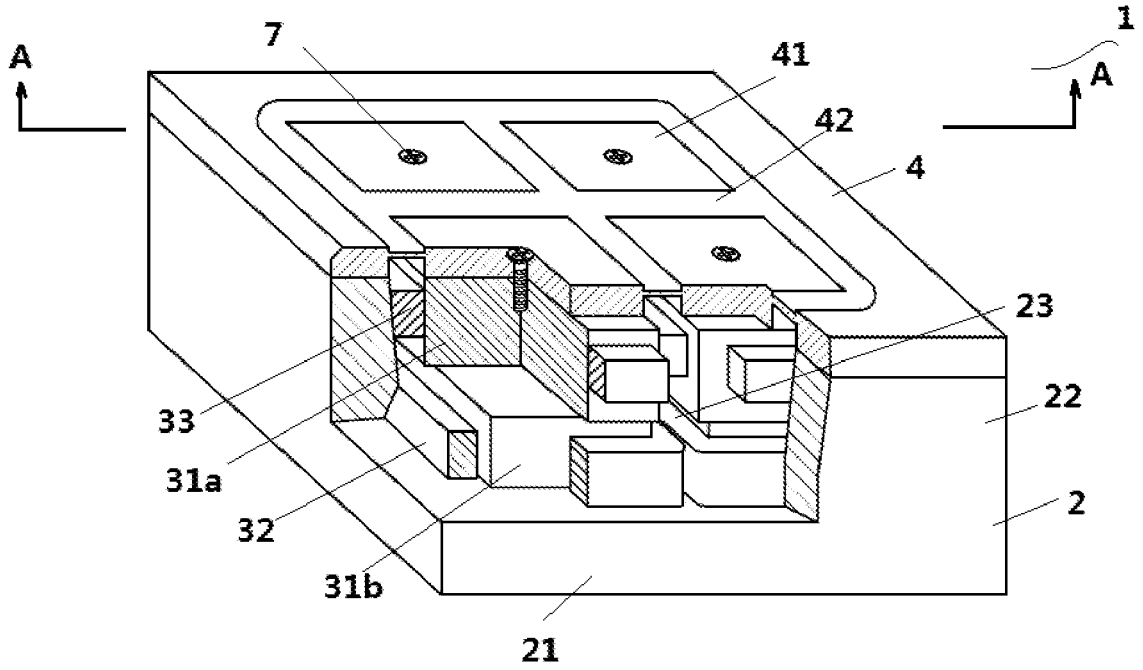
FIG. 3*a* is the three-dimensional broken-out section view of the leakage type magnetic holding device based on the third embodiment of the present disclosure.
Figure 3B:
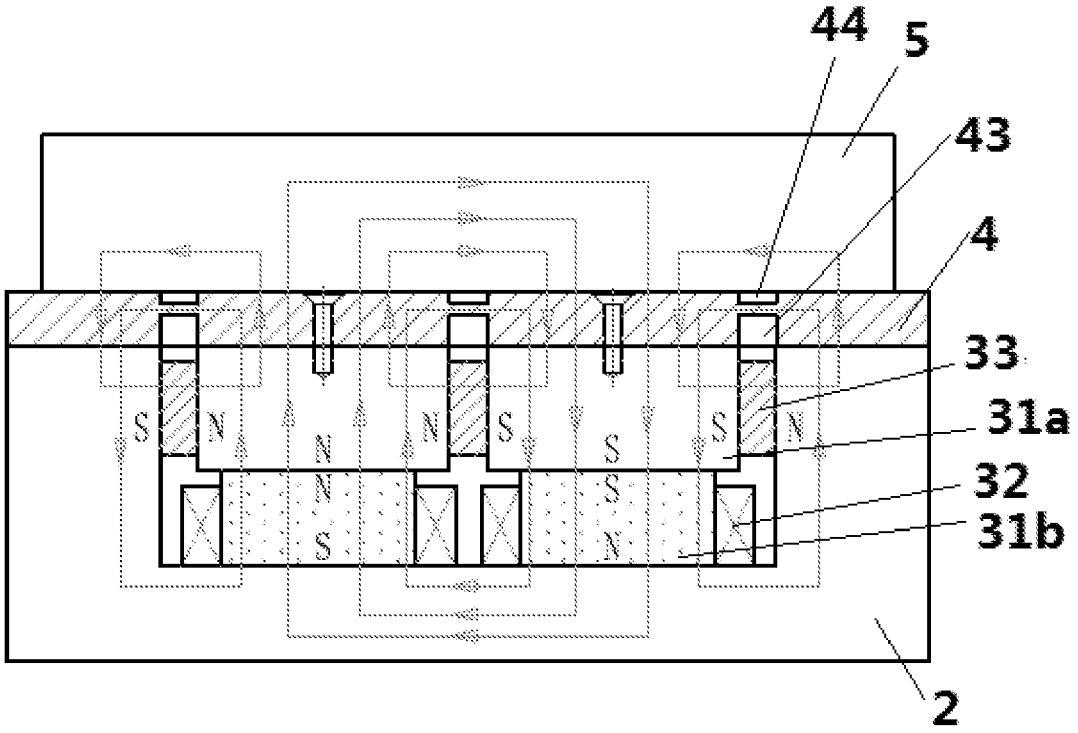
FIG. 3*b* is the section view along line A-A in FIG. 3*a* of the leakage type magnetic holding device based on the third embodiment of the present disclosure under excitation condition.
Figure 3C:
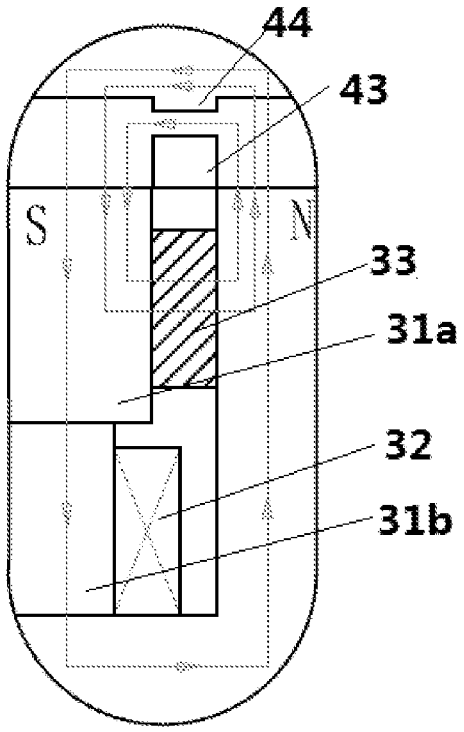
FIG. 3*c* is the partially enlarged view of FIG. 3*b;*
Figure 3D:
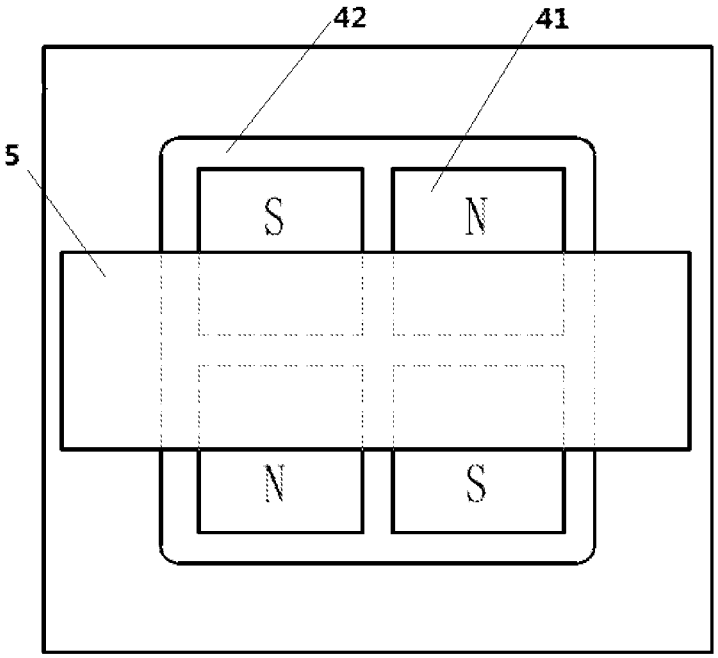
FIG. 3*d* is the top view of the leakage type magnetic holding device based on the third embodiment of the present disclosure under excitation condition.

FIG. 3*a* shows the three-dimensional, broken-out section view of the leakage type magnetic holding device 1 based on the third embodiment of the present disclosure; FIG. 3*b* shows the section view along line A-A in FIG. 3*a* of the leakage type magnetic holding device 1 based on the third embodiment of the present disclosure under excitation condition; FIG. 3*c* is the partially enlarged view of FIG. 3*b*; FIG. 3*d* shows the top view of the leakage type magnetic holding device 1 based on the third embodiment of the present disclosure under excitation condition. In the appended drawings used in this embodiment, the same definitions are followed for the reference numbers identical with those in the above embodiments.

Leakage type magnetic holding device 1 based on the third embodiment of the present disclosure is a leakage type electric permanent magnetic holding device with magnetic variation.

The difference between the leakage type magnetic holding device 1 of the third embodiment and that of the second embodiment lies in that the source magnet 3 also contains an irreversible magnet 33 set around the periphery of each core block 31*a* in several source magnets 3. Permanent magnets, such as NdFeB, can be chosen for the irreversible magnet 33.

As shown in FIGS. 3*a*, 3*b*, and 3*c*, instantaneous current runs through field coil 32, reversible magnet 31*b* is excited in forward direction, polarity N-S is exhibited from top to bottom; when the adjacent reversible magnet 31*b* is excited, polarity S-N is exhibited from top to bottom, thus magnetic circuits as shown in FIG. 3*b* are formed among the reversible magnet 31*b*, the adjacent reversible magnet 31*b*, the leakage type magnetic conductive coverplate 4, the core block 31*a*, the workpiece 5, and the base 2, and among the core block 31*a*, the irreversible magnet 33, the leakage type magnetic conductive coverplate 4, the side wall 22, and the workpiece 5, and among the core block 31*a*, the irreversible magnet 33, the workpiece 5, and the leakage type magnetic conductive coverplate 4. In this way, the leakage type magnetic holding device 1 shows magnetism externally, holding the workpiece 5 to be processed onto the outer surface of the leakage type magnetic conductive coverplate 4.

In the case that holding needs to be released, instantaneous reverse current runs through the field coil 32, the reversible magnet 31*b* is excited in reverse direction, polarity S-N is exhibited from top to bottom; when the adjacent reversible magnet 31*b* is excited, polarity N-S is exhibited from top to bottom, thus magnetic short-circuits are formed among the reversible magnet 31*b*, the adjacent reversible magnet 31*b*, the irreversible magnet 33, the core block 31*a*, and the lower base 2, and among the reversible magnet 31*b*, the lower base 2, the side wall 22, the irreversible magnet 33, and the core block 31*a*. In this way, the leakage type magnetic holding device 1 does not show magnetism externally, holding of the workpiece 5 on the outer surface of the leakage type magnetic conductive coverplate 4 is released.

Figure 4A:
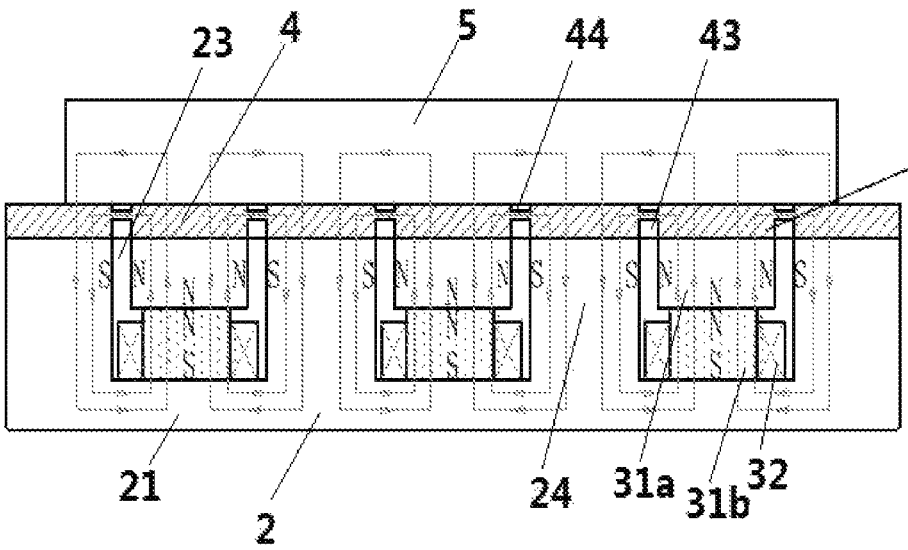
FIG. 4*a* is the section view of the leakage type magnetic holding device based on the fourth embodiment of the present disclosure under excitation condition.
Figure 4B:
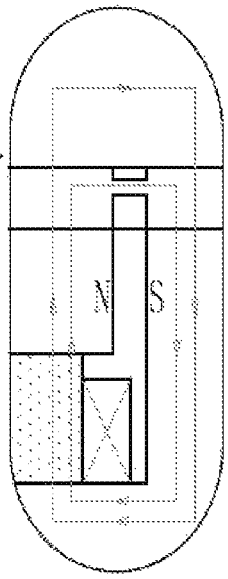
FIG. 4*b* is the partially enlarged view of FIG. 4*a;*
Figure 4C:
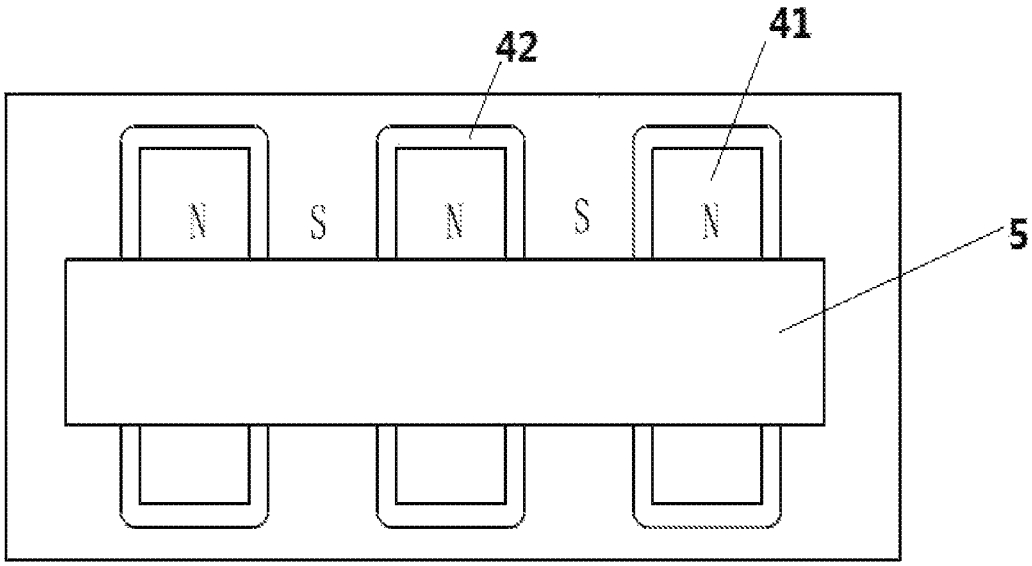
FIG. 4*c* is the top view of the leakage type magnetic holding device based on the fourth embodiment of the present disclosure under excitation condition.
Figure 4D:
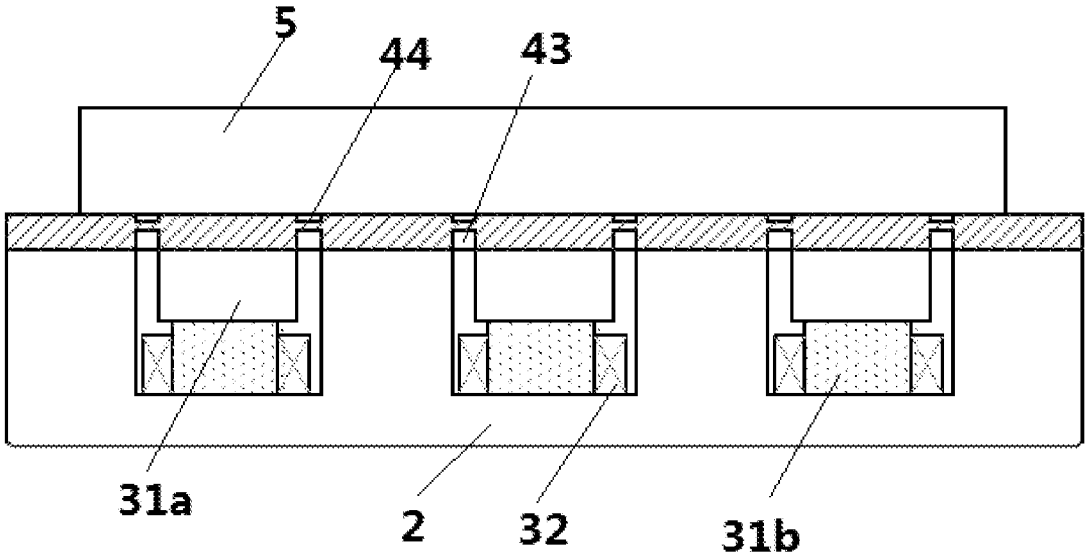
FIG. 4*d* is the section view of the leakage type magnetic holding device based on the fourth embodiment of the present disclosure under demagnetization condition.
Figure 4E:
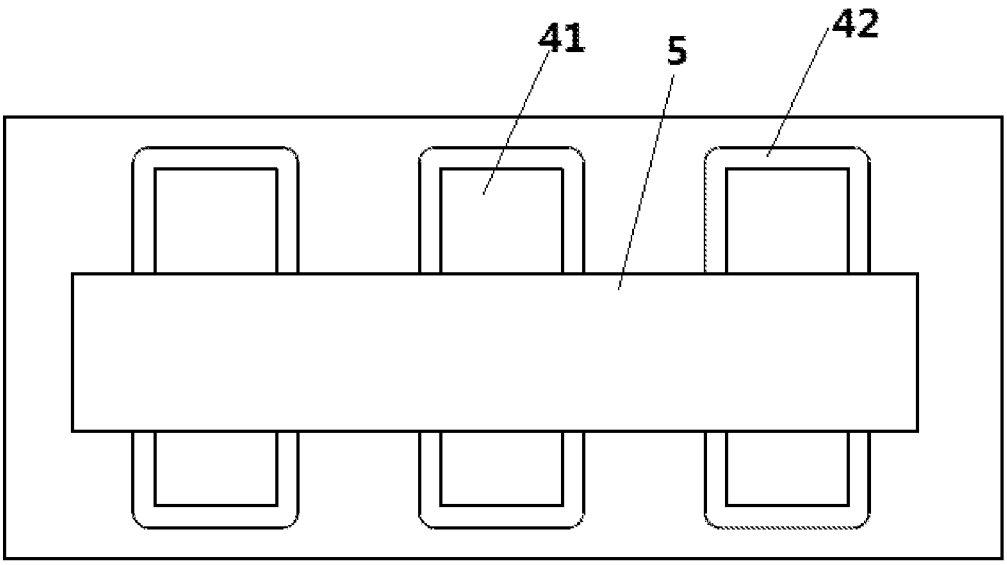
FIG. 4*e* is the top view of the leakage type magnetic holding device based on the fourth embodiment of the present disclosure under demagnetization condition.

FIG. 4*a* shows the section view of the leakage type magnetic holding device 1 based on the fourth embodiment of the present disclosure under excitation condition; FIG. 4*b* is the partially enlarged view of FIG. 4*a*; FIG. 4*c* shows the top view of the leakage type magnetic holding device 1 based on the fourth embodiment of the present disclosure under excitation condition; FIG. 4*d* is the section view of the leakage type magnetic holding device based on the fourth embodiment of the present disclosure under demagnetization condition; FIG. 4*e* is the top view of the leakage type magnetic holding device of the fourth embodiment of the present disclosure under demagnetization condition. In the appended drawings used in this embodiment, the same definitions are followed for the reference numbers identical with those in the above embodiments.

The fourth embodiment is a variation of the second embodiment. As shown in FIGS. 4*a* to 4*d*, the difference between leakage type magnetic holding device 1 of the fourth embodiment and that of the second embodiment lies in that the number of the source magnets 3 is set to three, and three source magnets 3 are arranged in one line in the cavity 23 in the base 2. More specifically, the number of source magnets 3 is set to three, but not limited to three, and any two of the three source magnets 3 have a partition wall 24 in between. The partition wall 24 extends from the inner surface of the bottom 21 of the base 2 to the inner surface, which faces the bottom 21, of the leakage type magnetic conductive coverplate 4. More specifically, the partition wall 24 is also made of magnetic conductive material, and is integrated with the bottom 21.

Figure 5A:
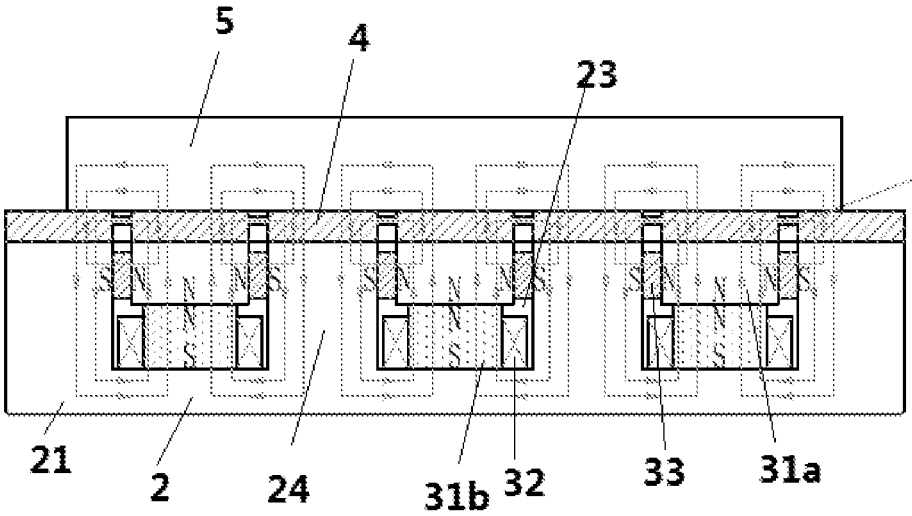
FIG. 5*a* is the section view of the leakage type magnetic holding device based on the fifth embodiment of the present disclosure under excitation condition.
Figure 5B:
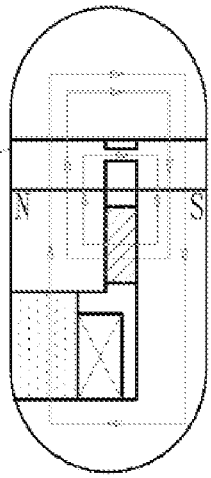
FIG. 5*b* is the partially enlarged view of FIG. 5*a;*
Figure 5C:
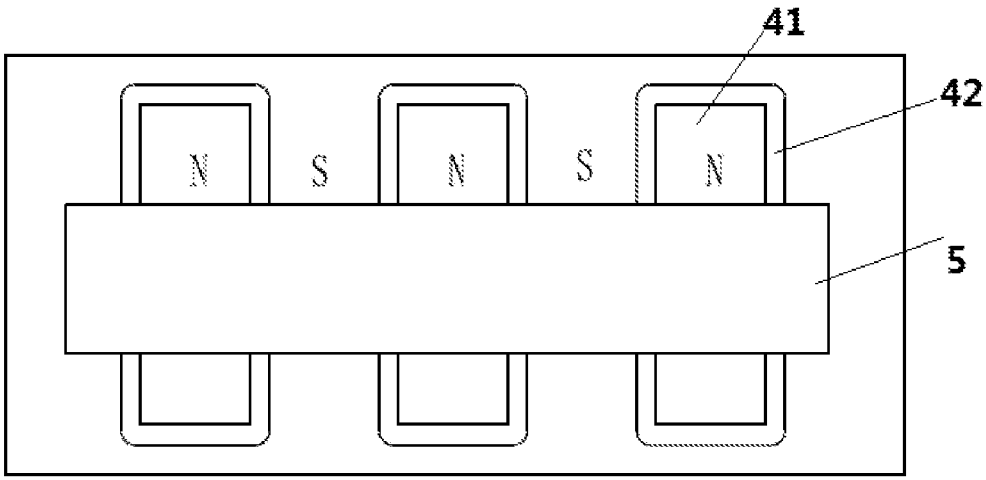
FIG. 5*c* is the top view of the leakage type magnetic holding device based on the fifth embodiment of the present disclosure under excitation condition.
Figure 5D:
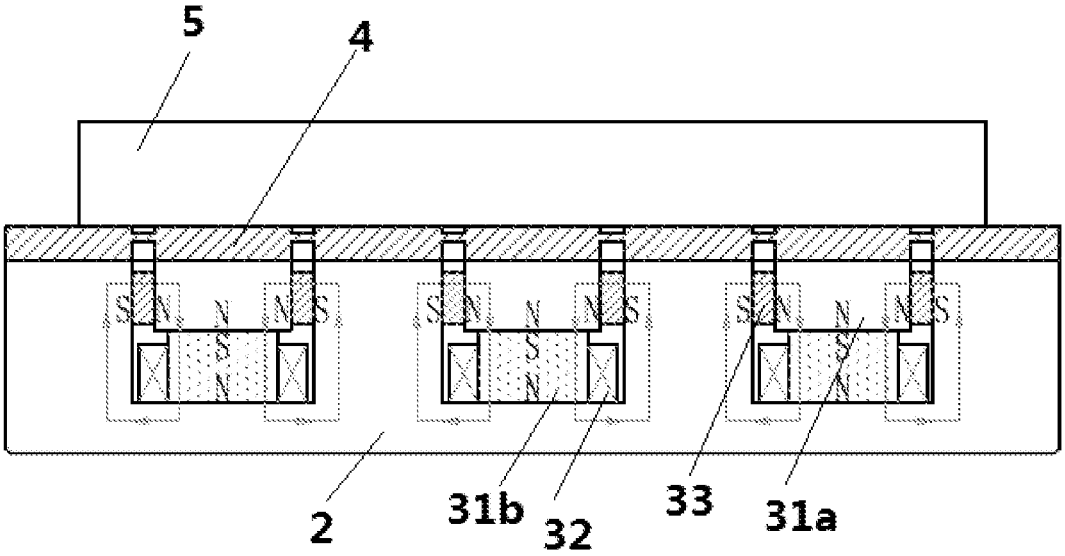
FIG. 5*d* is the section view of the leakage type magnetic holding device base on the fifth embodiment of the present disclosure under demagnetization condition.
Figure 5E:
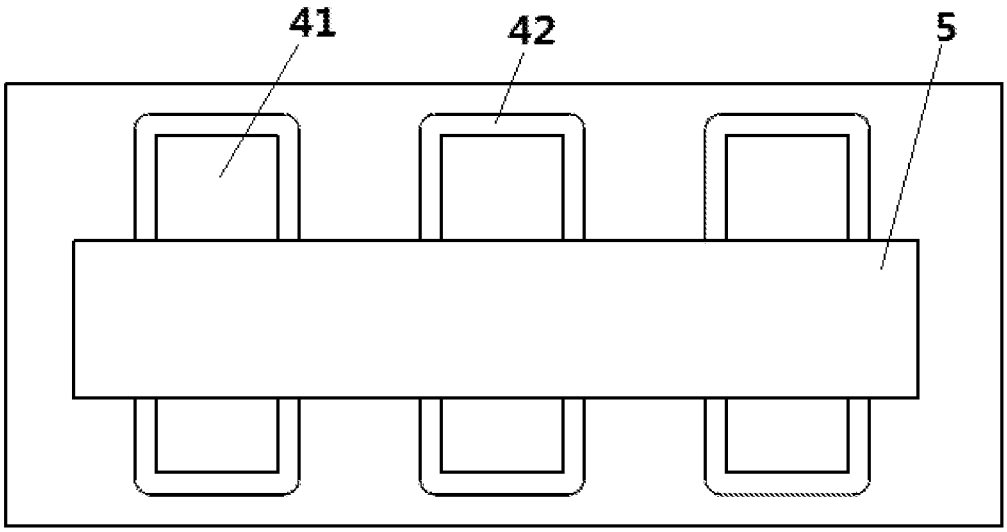
FIG. 5*e* is the top view of the leakage type magnetic holding device base on the fifth embodiment of the present disclosure under demagnetization condition.

FIG. 5*a* shows the section view of leakage type magnetic holding device 1 based on the fifth embodiment of the present disclosure under excitation condition; FIG. 5*b* is the partially enlarged view of FIG. 5*a*; FIG. 5*c* shows the top view of leakage type magnetic holding device 1 based on the fifth embodiment of the present disclosure under excitation condition; FIG. 5*d* is the section view of the leakage type magnetic holding device 1 based on the fifth embodiment of the present disclosure under demagnetization condition; FIG. 5*e* is the top view of the leakage type magnetic holding device 1 of the fifth embodiment of the present disclosure under demagnetization condition. In the appended drawings used in this embodiment, the same definitions are followed for the reference numbers identical with those in the above embodiments.

The fifth embodiment is a variation of the third embodiment. As shown in FIGS. 5*a* to 5*d*, the difference between the leakage type magnetic holding device 1 of the fifth embodiment and that of the third embodiment lies in that the number of the source magnets 3 is set to three, and three source magnets 3 are arranged in one line in the cavity 23 in the base 2. More specifically, the number of source magnets 3 is set to three, but not limited to three, and any two of the three source magnets 3 have a partition wall 24 in between. The partition wall 24 extends from the inner surface of the bottom 21 of the base 2 to the inner surface, which faces the bottom 21, of the leakage type magnetic conductive coverplate 4. More specifically, partition wall 24 is also made of magnetic conductive material, and is integrated with the bottom 21.

Figure 6A:
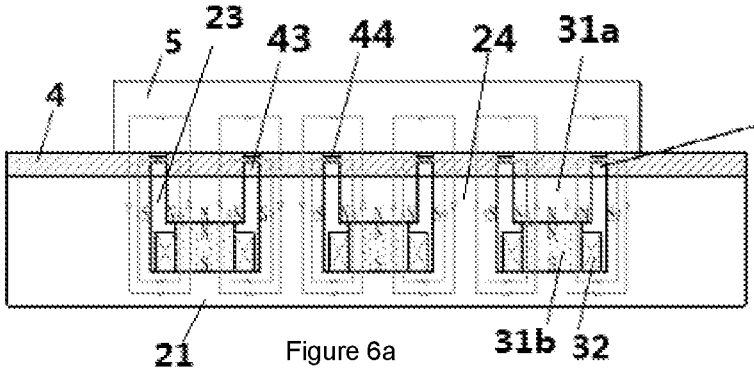
FIG. 6*a* is the section view of the leakage type magnetic holding device based on the sixth embodiment of the present disclosure under excitation condition.
Figure 6B:
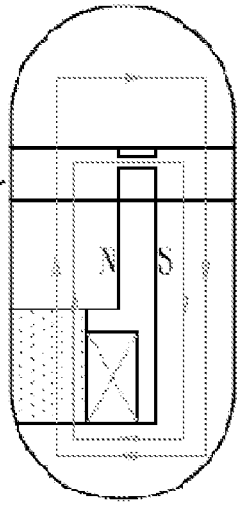
FIG. 6*b* is the partially enlarged view of FIG. 6*a;*
Figure 6C:
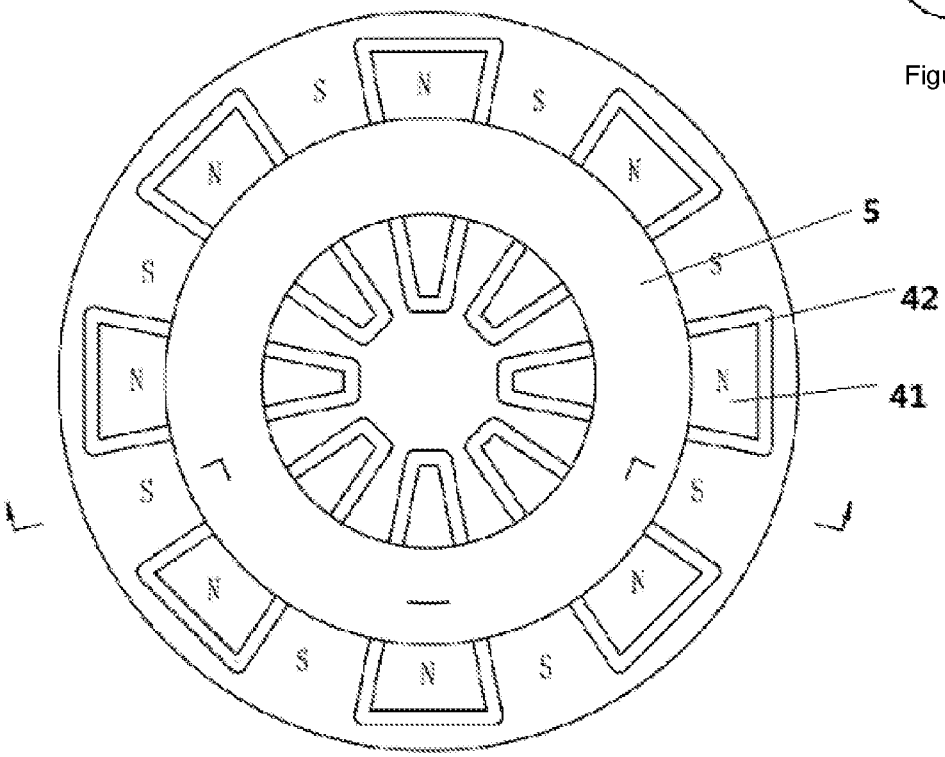
FIG. 6*c* is the top view of the leakage type magnetic holding device based on the sixth embodiment of the present disclosure under excitation condition.
Figure 6D:
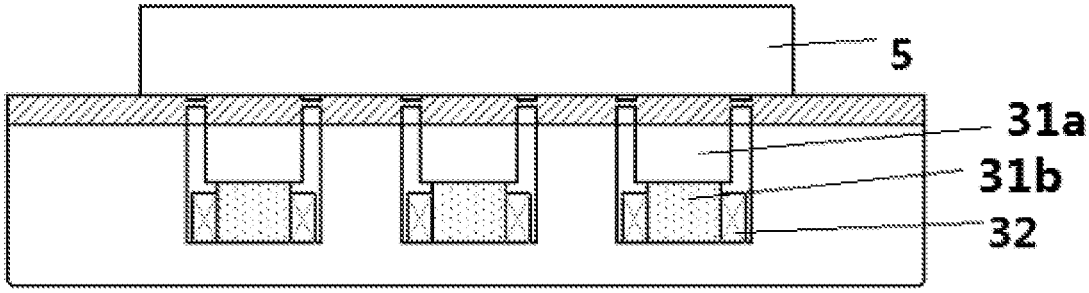
FIG. 6*d* is the section view of the leakage type magnetic holding device based on the sixth embodiment of the present disclosure under demagnetization condition.
Figure 6E:
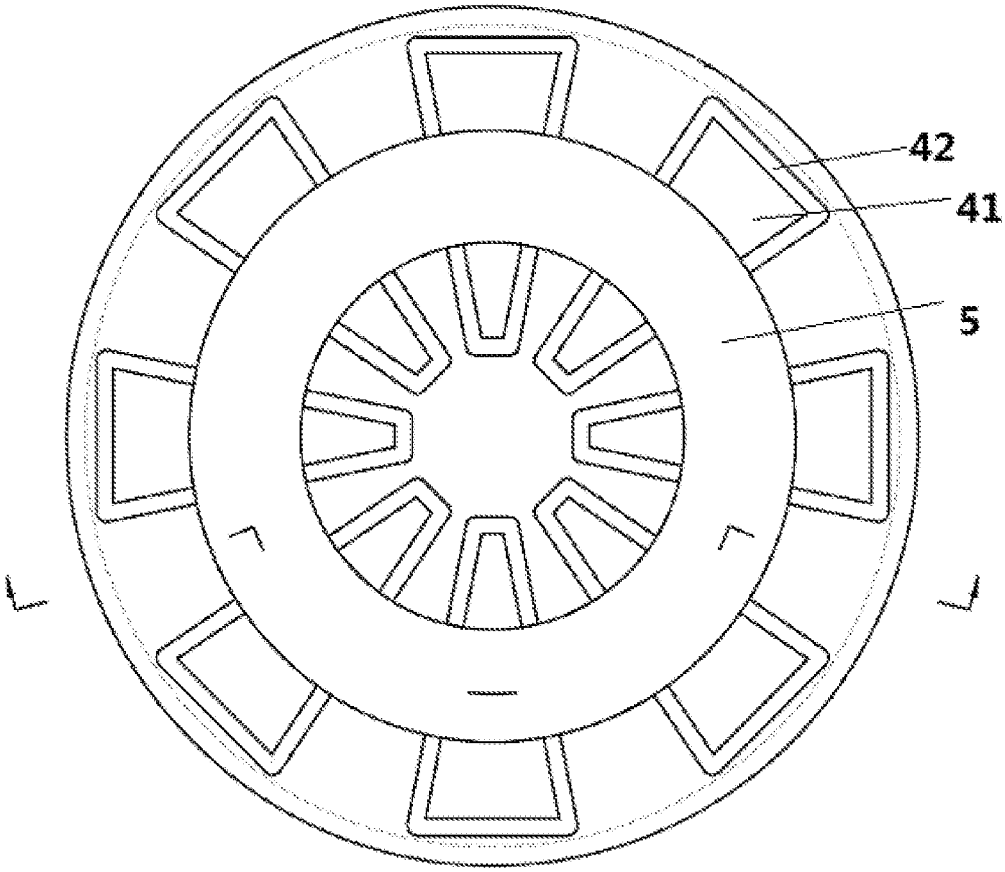
FIG. 6*e* is the top view of the leakage type magnetic holding device based on the sixth embodiment of the present disclosure under demagnetization condition.

FIG. 6*a* shows the section view of the leakage type magnetic holding device 1 based on the sixth embodiment of the present disclosure under excitation condition; FIG. 6*b* is the partially enlarged view of FIG. 6*a*; FIG. 6*c* shows the top view of the leakage type magnetic holding device 1 based on the sixth embodiment of the present disclosure under excitation condition; FIG. 6*d* is the section view of the leakage type magnetic holding device 1 based on the sixth embodiment of the present disclosure under demagnetization condition; FIG. 6*e* is the top view of the leakage type magnetic holding device 1 of the sixth embodiment of the present disclosure under demagnetization condition. In the appended drawings used in this embodiment, the same definitions are followed for the reference numbers identical with those in the above embodiments.

The sixth embodiment is a variation of the second embodiment. As shown in FIGS. 6*a* to 6*c*, the difference between the leakage type magnetic holding device 1 of the sixth embodiment and that of the second embodiment lies in that the leakage type magnetic holding device 1 of the sixth embodiment is cylindrical; the upper surface of the leakage type magnetic conductive coverplate 4 is circular, and can be used as the working surface for processing the ring-shaped workpiece 5; several source magnets 3 in the cavity 23 in the base 2 are evenly distributed in the cavity 23 in the base 2 in circumferential direction, and the cross section of the core block 31*a* in each source magnet 3, parallel with the upper surface of the leakage type magnetic conductive coverplate 4, is trapezoidal. More specifically, the number of several source magnets 3 is set to eight, but not limited to eight, and any two of the several source magnets 3 have a partition wall 24 in between. The partition wall 24 extends from the inner surface of the bottom 21 of the base 2 to the inner surface, which faces the bottom 21, of leakage type magnetic conductive coverplate 4. More specifically, partition wall 24 is also made of magnetic conductive material, and is integrated with the bottom 21. One of ordinary skill in the art should understand that the structure of leakage type magnetic holding device is not limited to enumeration in this embodiment, there are also other structures to be included with the same functions, for instance, the cross section of the core block 31*a* in the source magnet 3 of the leakage type magnetic holding device 1, parallel with the outer surface of leakage type magnetic conductive coverplate 4, may also be triangular.

As shown in FIGS. 6*a* to 6*c*, instantaneous forward current runs through a field coil 32, all reversible magnets 31*b* are excited in forward direction, exhibiting polarities N-S from top to bottom, thus magnetic circuits as shown in FIG. 6*a* are formed among the workpiece 5, the side wall 22, the base 2, the leakage type magnetic conductive coverplate 4, the reversible magnet 31*b*, and the core block 31*a*, and among workpiece 5, the core block 31*a*, the reversible magnet 31*b*, the leakage type magnetic conductive coverplate 4, the lower base 2 and the partition wall 24. In this way, the leakage type magnetic holding device 1 shows magnetism externally, holding the workpiece 5 to be processed onto the outer surface of leakage type magnetic conductive coverplate 4.

As shown in FIG. 6*d*, in the case that holding needs to be released, the current with gradually attenuating oscillation runs through the field coil 32, the reversible magnet 31*b* is demagnetized gradually, so that leakage type magnetic holding device 1 does not show magnetism externally, holding of the workpiece 5 on the outer surface of the leakage type magnetic conductive coverplate 4 is released.

Figure 7A:
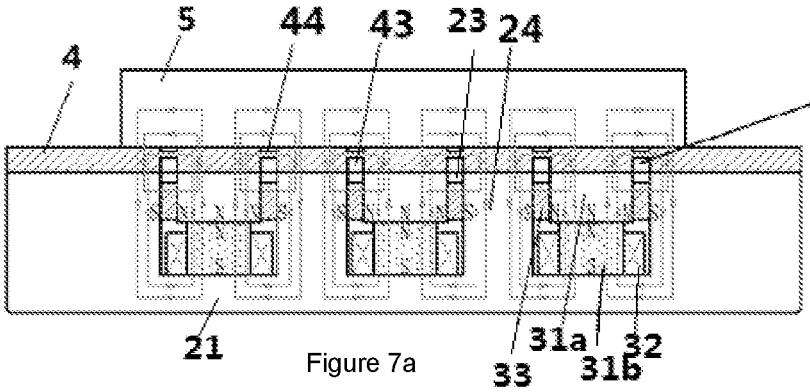
FIG. 7*a* is the section view of the leakage type magnetic holding device based on the seventh embodiment of the present disclosure under excitation condition.
Figure 7B:
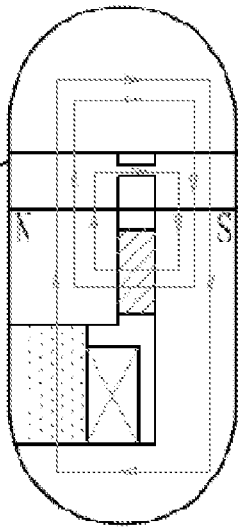
FIG. 7*b* is the partially enlarged view of FIG. 7*a;*
Figure 7C:
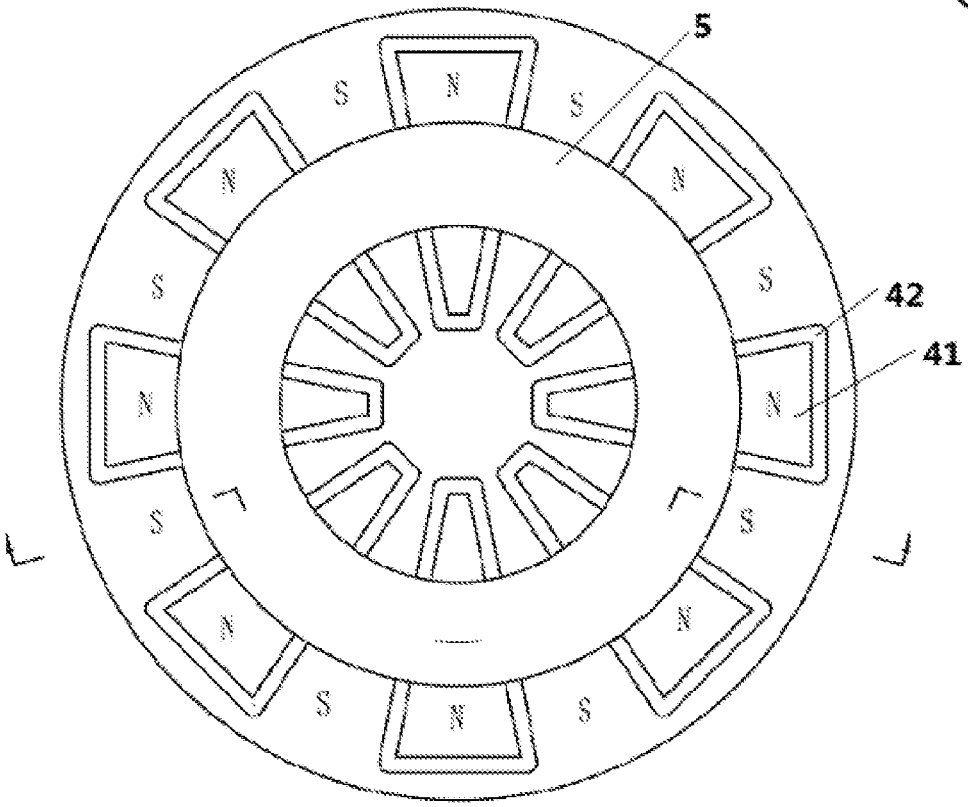
FIG. 7*c* is the top view of the leakage type magnetic holding device based on the seventh embodiment of the present disclosure under excitation condition.
Figure 7D:
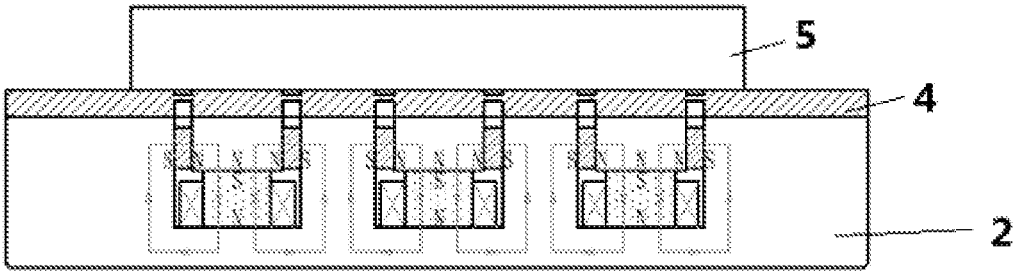
FIG. 7*d* is the section view of the leakage type magnetic holding device based on the seventh embodiment of the present disclosure under demagnetization condition.
Figure 7E:
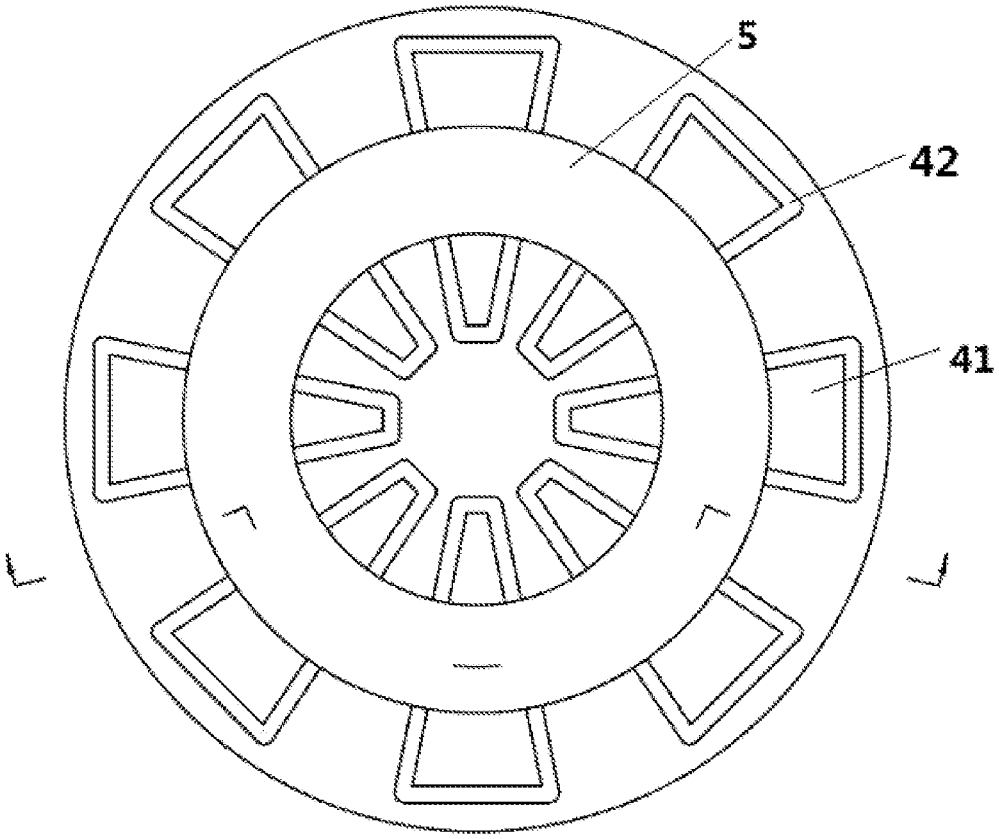
FIG. 7*e* is the top view of the leakage type magnetic holding device based on the seventh embodiment of the present disclosure under demagnetization condition.

FIG. 7*a* shows the section view of the leakage type magnetic holding device 1 based on the seventh embodiment of the present disclosure under excitation condition; FIG. 7*b* is the partially enlarged view of FIG. 7*a*; FIG. 7*c* shows the top view of the leakage type magnetic holding device 1 based on the seventh embodiment of the present disclosure under excitation condition; FIG. 7*d* is the section view of the leakage type magnetic holding device 1 based on the seventh embodiment of the present disclosure under demagnetization condition; FIG. 7*e* is the top view of the leakage type magnetic holding device 1 of the seventh embodiment of the present disclosure under demagnetization condition. In the appended drawings used in this embodiment, the same definitions are followed for the reference numbers identical with those in the above embodiments.

The seventh embodiment is a variation of the third embodiment. As shown in FIGS. 7*a* to 7*d*, the difference between the leakage type magnetic holding device 1 of the seventh embodiment and that of the third embodiment lies in that the leakage type magnetic holding device 1 of the seventh embodiment is cylindrical; the upper surface of the leakage type magnetic conductive coverplate 4 is circular, and can be used as the working surface for processing the ring-shaped workpiece 5; several source magnets 3 in the cavity 23 in the base 2 are evenly distributed in the cavity 23 in the base 2 in circumferential direction, and the cross section of the core block 31*a* in each source magnet 3, parallel with the outer surface of the leakage type magnetic conductive coverplate 4, is trapezoidal. More specifically, the number of several source magnets 3 is set to eight, but not limited to eight, and any two of the several source magnets 3 have a partition wall 24 in between. The partition wall 24 extends from the inner surface of the bottom 21 of the base 2 to the inner surface, which faces the bottom 21, of the leakage type magnetic conductive coverplate 4. More specifically, the partition wall 24 is also made of magnetic conductive material, and is integrated with the bottom 21. One of ordinary skill in the art should understand that the structure of the leakage type magnetic holding device is not limited to enumeration in this embodiment, there are also other structures to be included with the same functions, for instance, the cross section of the core block 31*a* in the source magnet 3 of the leakage type magnetic holding device 1, parallel with the outer surface of the leakage type magnetic conductive coverplate 4, may also be triangular.

As shown in FIGS. 7*a* to 7*c*, instantaneous forward current runs through the field coil 32, all reversible magnets 31*b* are excited in forward direction, exhibiting polarities N-S from top to bottom, thus magnetic circuits as shown in FIG. 7*a* are formed among the workpiece 5, the side wall 4, the lower base 2, the leakage type magnetic conductive coverplate 4, the reversible magnet 31*b* and the core block 31*a*, and among the workpiece 5, the core block 31*a*, the reversible magnet 31*b*, the leakage type magnetic conductive coverplate 4, the lower base 2 and the partition wall 24, and among the workpiece 5, the side wall 22, the leakage type magnetic conductive coverplate 4, the irreversible magnet 33 and the core block 31*a*, and among the workpiece 5, the partition wall 24, the leakage type magnetic conductive coverplate 4, the irreversible magnet 33 and the core block 31*a*. In this way, the leakage type magnetic holding device 1 shows magnetism externally, holding the workpiece 5 to be processed onto the outer surface of the leakage type magnetic conductive coverplate 4.

As shown in FIG. 7*d*, in the case that holding needs to be released, instantaneous reverse current runs through the field coil 32, all reversible magnets 31*b* are excited in reverse direction, exhibiting polarities S-N from top to bottom, thus magnetic short-circuits as shown in FIG. 7*d* are formed among the side wall 22, the lower base 2, the reversible magnet 31*b*, the core block 31*a*, and the irreversible magnet 33, and among the core block 31*a*, the reversible magnet 31*b*, the lower base 2, the partition wall 24, and the irreversible magnet 33. In this way, the leakage type magnetic holding device 1 does not show magnetism externally, holding of the workpiece 5 on the outer surface of the leakage type magnetic conductive coverplate 4 is released.

Figure 8A:
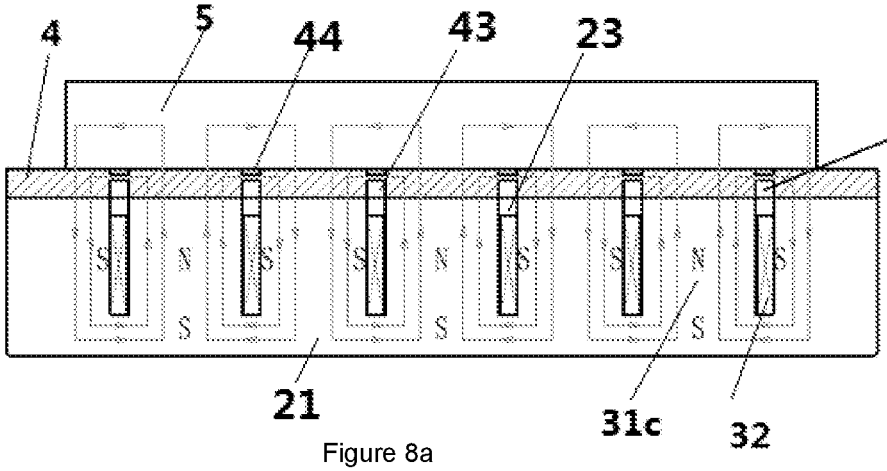
FIG. 8*a* is the section view of the leakage type magnetic holding device based on the eighth embodiment of the present disclosure under excitation condition.
Figure 8B:
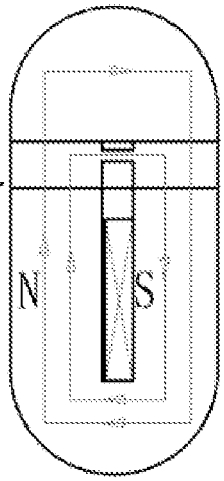
FIG. 8*b* is the partially enlarged view of FIG. 8*a;*
Figure 8C:
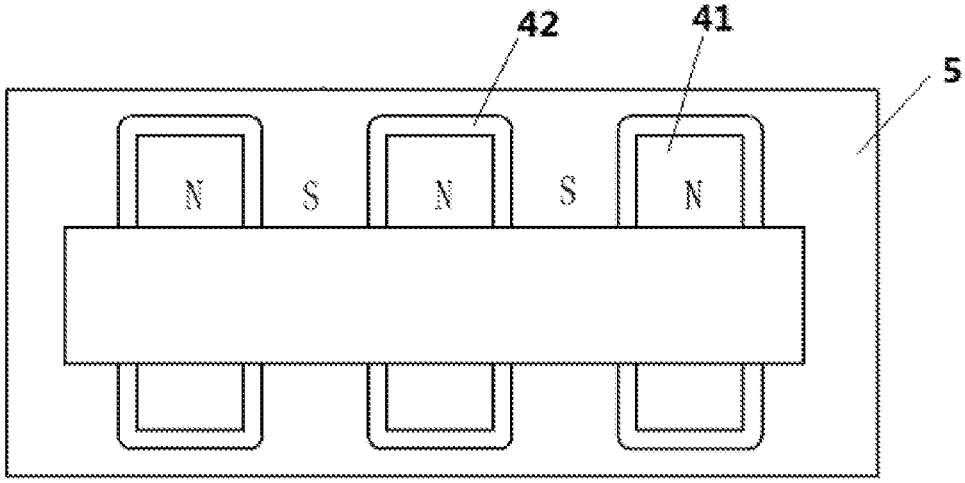
FIG. 8*c* is the top view of the leakage type magnetic holding device based on the eighth embodiment of the present disclosure under excitation condition.
Figure 8D:
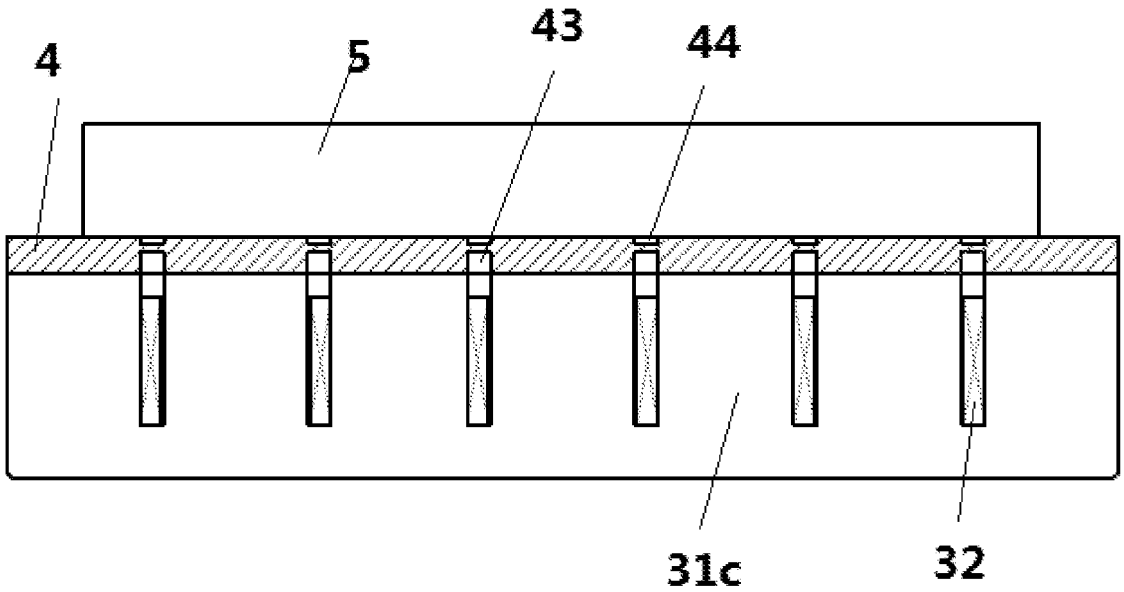
FIG. 8*d* is the section view of the leakage type magnetic holding device based on the eighth embodiment of the present disclosure under demagnetization condition.
Figure 8E:
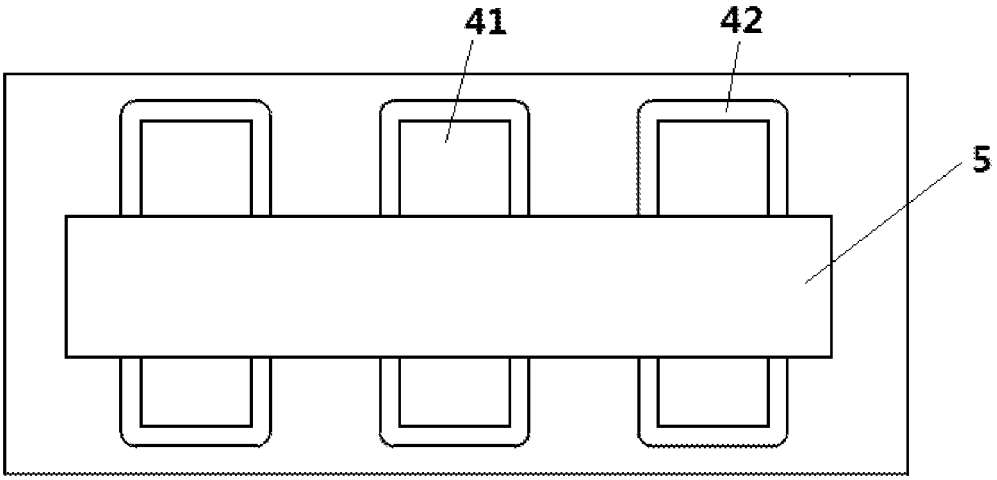
FIG. 8*e* is the top view of the leakage type magnetic holding device based on the eighth embodiment of the present disclosure under demagnetization condition.

FIG. 8*a* shows the section view of the leakage type magnetic holding device 1 based on the eighth embodiment of the present disclosure under excitation condition; FIG. 8*b* is the partially enlarged view of FIG. 8*a*; FIG. 8*c* shows the top view of the leakage type magnetic holding device 1 based on the eighth embodiment of the present disclosure under excitation condition; FIG. 8*d* is the section view of the leakage type magnetic holding device 1 based on the eighth embodiment of the present disclosure under demagnetization condition; FIG. 8*e* is the top view of the leakage type magnetic holding device 1 of the eighth embodiment of the present disclosure under demagnetization condition. In the appended drawings used in this embodiment, the same definitions are followed for the reference numbers identical with those in the above embodiments.

The eighth embodiment is a variation of the fourth embodiment. As shown in FIGS. 8*a* to 8*c*, the difference between the leakage type magnetic holding device 1 of the eighth embodiment and that of the fourth embodiment lies in that the leakage type magnetic holding device 1 in the eighth embodiment is a leakage type electromagnetic holding device, i.e., source magnets 3 in the eighth embodiment do not have reversible magnet 31*b*, and each source magnet 3 contains an iron core 31*c*, which faces the interior of cavity 23 from the inner surface of the bottom 21 of the base 2, and is perpendicular to the inner surface of the bottom 21 and extends to the inner surface of the leakage type magnetic conductive coverplate 4, and the field coil 32 set around corresponding iron core 31*c* one-to-one. That is, in the eighth embodiment, the source magnets 3 do not have reversible magnet 31*b*, and the field coil 32 is set around the circumference of the iron core 31*c*. When direct current runs through the field coil 32 continuously, magnetic flux is produced in the iron core 31*c* to form a magnetic circuit, as shown in FIG. 8*a*, so that the holding device shows magnetism externally. When current stops flow in the field coil 32, magnetic flux disappears in the iron core 31*c*, so that the holding device does not show magnetism externally.

Figure 9A:
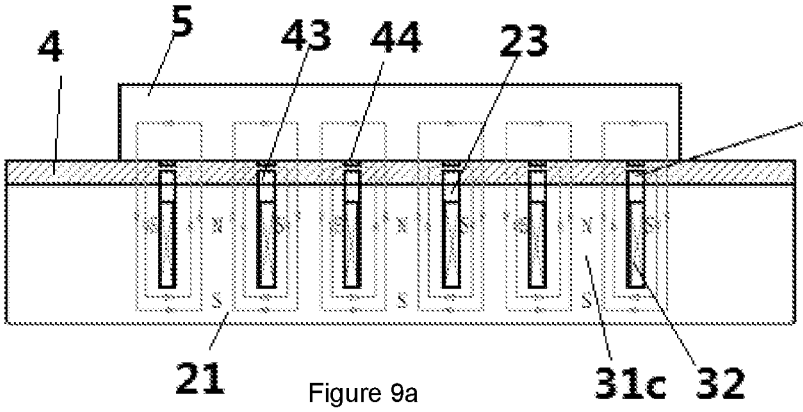
FIG. 9*a* is the section view of the leakage type magnetic holding device based on the ninth embodiment of the present utility disclosure excitation condition.
Figure 9B:
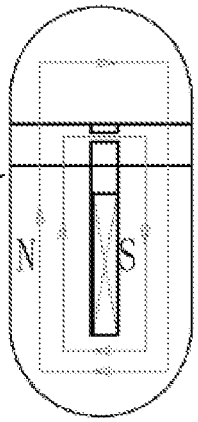
FIG. 9*b* is the partially enlarged view of FIG. 9*a;*
Figure 9C:
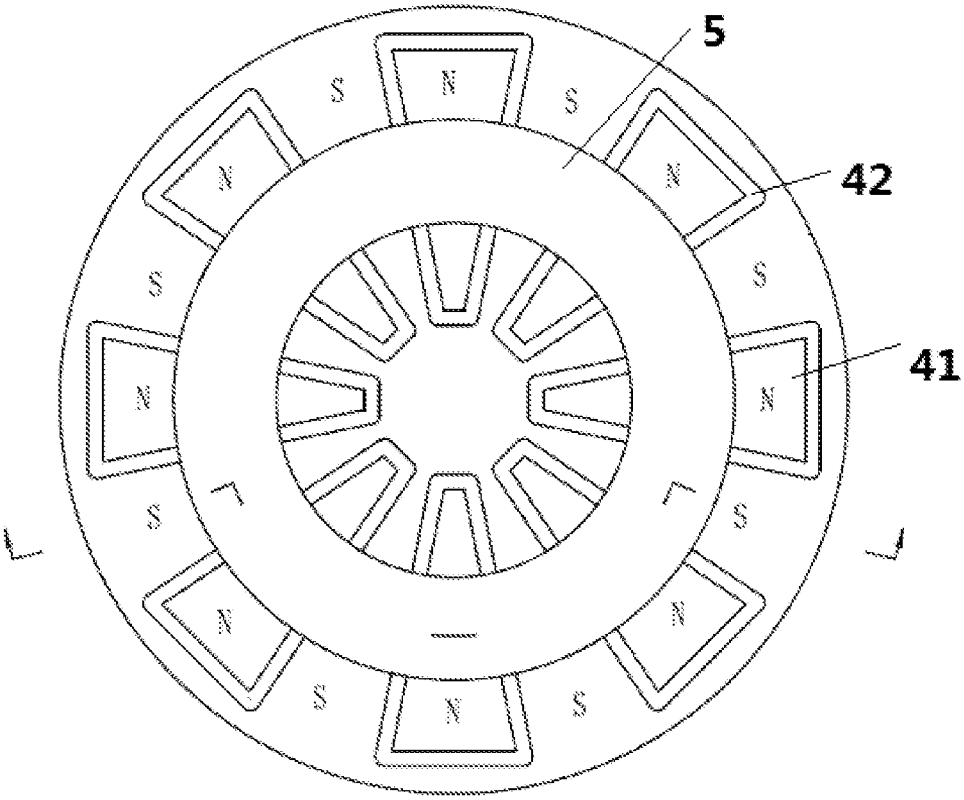
FIG. 9*c* is the top view of the leakage type magnetic holding device based on the ninth embodiment of the present disclosure under excitation condition.
Figure 9D:
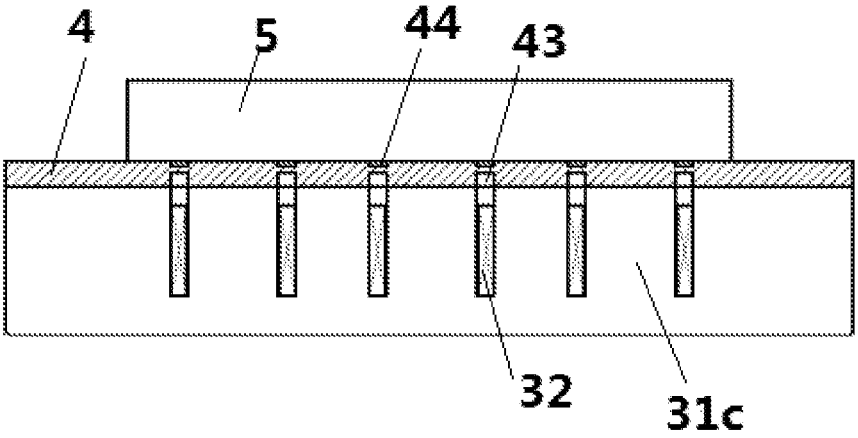
FIG. 9*d* is the section view of the leakage type magnetic holding device based on the ninth embodiment of the present disclosure under demagnetization condition.
Figure 9E:
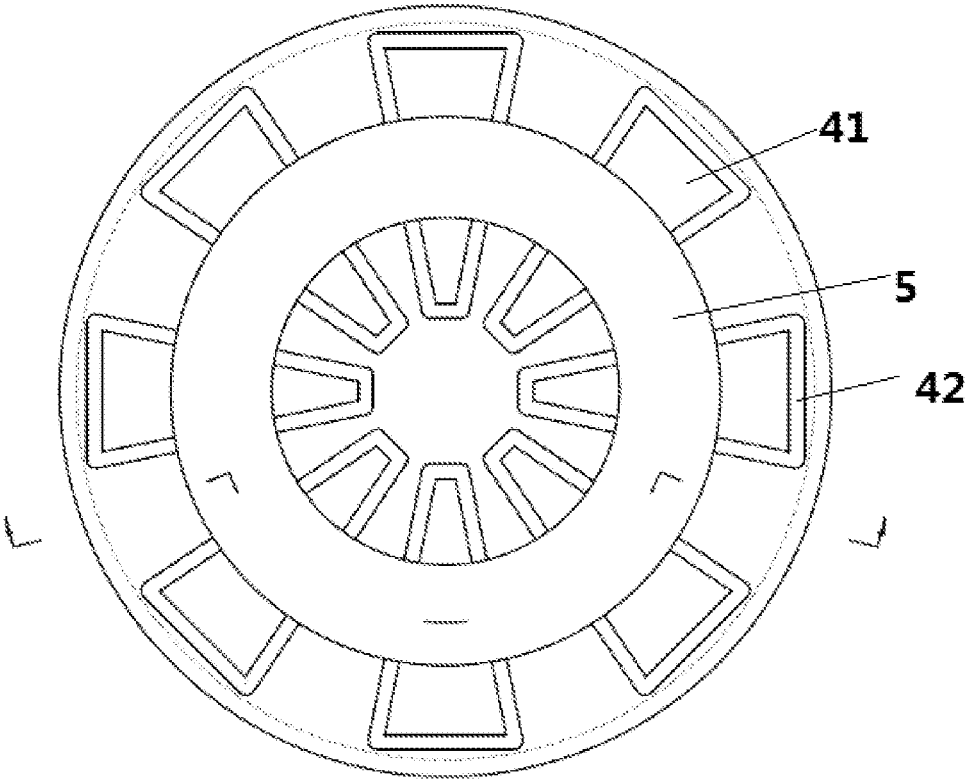
FIG. 9*e* is the top view of the leakage type magnetic holding device based on the ninth embodiment of the present disclosure under demagnetization condition.

FIG. 9*a* shows the section view of the leakage type magnetic holding device 1 based on the ninth embodiment of the present disclosure under excitation condition; FIG. 9*b* is the partially enlarged view of FIG. 9*a*; FIG. 9*c* shows the top view of the leakage type magnetic holding device 1 based on the ninth embodiment of the present disclosure under excitation condition; FIG. 9*d* is the section view of the leakage type magnetic holding device 1 based on the ninth embodiment of the present disclosure under demagnetization condition; FIG. 9*e* is the top view of the leakage type magnetic holding device 1 of the ninth embodiment of the present disclosure under demagnetization condition. In the appended drawings used in this embodiment, the same definitions are followed for the reference numbers identical with those in the above embodiments.

The ninth embodiment is a variation of the sixth embodiment. As shown in FIGS. 9*a* to 9*d*, the difference between the leakage type magnetic holding device 1 of the ninth embodiment and that of the sixth embodiment lies in that the leakage type magnetic holding device 1 in the ninth embodiment is a leakage type electromagnetic holding device, i.e., source magnets 3 in the ninth embodiment do not have the reversible magnet 31*b*, and each source magnet 3 contains an iron core 31*c*, which faces the interior of cavity 23 from the inner surface of the bottom 21 of the base 2, and is perpendicular to the inner surface of the bottom 21 and extends to the inner surface of the leakage type magnetic conductive coverplate 4, and the field coil 32 set around corresponding iron core 31*c*, one-to-one. That is, in the ninth embodiment, source magnets 3 do not have reversible magnet 31*b*, and the field coil 32 is set around the circumference of the iron core 31*c*. When direct current runs through the field coil 32 continuously, magnetic flux is produced in the iron core 31*c* to form a magnetic circuit, as shown in FIG. 9*a*, so that the holding device shows magnetism externally. When current stops flow in the field coil 32, magnetic flux disappears in the iron core 31*c*, so that the holding device does not show magnetism externally.

In conclusion, the leakage type magnetic conductive coverplate and the leakage type magnetic holding device provided by the present utility model make use of the leakage type magnetic conductive coverplate to cover the holding surface of the holding device, so that the surface in contact with workpiece on the holding device is made of one material. This avoids crevices produced due to different coefficients of expansion and contraction when there is any change in ambient temperature, and coolant and other magnetic conductive substances will not infiltrate into the holding device, thus prolonging service life of the holding device, therefore, it has high value for marketing. The above-described embodiments exemplify the principles and functions of the present utility model only, and are not used to restrict the present disclosure. On the premise of not going against the spirit and scope of the present disclosure, anyone familiar with the technology can make modifications or changes of the above-described embodiments. Therefore, all the equivalent modifications or changes made by the persons, who have common knowledge in this technical field, without disaffiliating from the spirit and technical thought revealed in the present utility model should still be covered in the scope claimed for protection of the present utility model.

The invention claimed is:

1. A removable magnetic conductive coverplate of leakage type for use in a fully functional magnetic holding device, the magnetic holding device comprising a base having a bottom and a surrounding slide wall perpendicular to the bottom, wherein a cavity having an opening at an upper portion thereof is formed by the bottom and the surrounding side wall, and a holding surface defining the opening at the upper portion of the cavity and formed jointly by a plurality of source magnets and a non-magnetic-conductive material, wherein the leakage type magnetic conductive coverplate covers the holding surface of the magnetic holding device and the leakage type magnetic conductive coverplate is fabricated integrally of a single magnetic conductive material.

2. The magnetic conductive coverplate of leakage type of claim 1, wherein the leakage type magnetic conductive coverplate seals the holding surface of the magnetic holding device.

3. The magnetic conductive coverplate of leakage type of claim 1, wherein the leakage type magnetic conductive coverplate contains a plurality of magnetic conductive areas and a magnetic leakage area surrounding the magnetic conductive areas, the plurality of magnetic conductive areas corresponding to the plurality of source magnets one to one within the magnetic holding device, the magnetic leakage area comprising an inner groove set on an inner surface of the leakage type magnetic conductive coverplate or an outer groove set on an outer surface of the leakage type magnetic conductive coverplate.

4. The magnetic conductive coverplate of leakage type of claim 3, wherein the magnetic leakage area comprises both the inner groove set on the inner surface of the leakage type magnetic conductive coverplate and the outer groove set on the outer surface of the leakage type magnetic conductive coverplate.

5. The magnetic conductive coverplate of leakage type of claim 4, wherein the inner groove set is separated from and opposite the outer groove set.

6. The magnetic conductive coverplate of leakage type of claim 4, wherein a depth of the inner groove set is greater than a depth of the outer groove set.

7. The magnetic conductive coverplate of leakage type of claim 1, wherein the magnetic conductive coverplate of leakage type is fixed to the magnetic holding device with a fastening mechanism.

8. The magnetic conductive coverplate of leakage type of claim 7, wherein the fastening mechanism comprises a plurality of screws, and wherein a plurality of the several magnetic conductive areas on the leakage type magnetic conductive coverplate comprises holes for inserting the screws.

9. The magnetic conductive coverplate of leakage type of claim 8, wherein the plurality of screws is inserted through the holes on the plurality of the several magnetic conductive areas on the leakage type magnetic conductive coverplate and into a corresponding plurality of threaded orifices to receive the plurality of screws formed in the magnetic holding device.

10. The magnetic conductive coverplate of leakage type of claim 9, wherein the corresponding plurality of threaded orifices to receive the plurality of screws formed in the magnetic holding device is formed in the holding surface of the plurality of source magnets.

11. The magnetic conductive coverplate of leakage type of claim 8, wherein the fastening mechanism further comprises frame walls disposed on an edge of the leakage type magnetic conductive coverplate, the frame walls engaging a matching structure on the magnetic holding device to restrain the leakage type magnetic conductive coverplate relative the magnetic holding device.

12. The magnetic conductive coverplate of leakage type of claim 7, wherein the fastening mechanism comprises a plurality of screws, and the magnetic holding surface comprises a plurality of corresponding holes for inserting the screws in and through a base of the magnetic holding device and a corresponding plurality of threaded orifices is formed within the magnetic holding device to receive the plurality of screws.

13. The magnetic conductive coverplate of leakage type of claim 12, wherein the corresponding plurality of threaded orifices is formed on an inner surface of the leakage type magnetic conductive coverplate.

14. The magnetic conductive coverplate of leakage type of claim 7, wherein the fastening mechanism further comprises frame walls disposed on an edge of the leakage type magnetic conductive coverplate, the frame walls engaging a matching structure on the magnetic holding device to restrain the leakage type magnetic conductive coverplate relative the magnetic holding device.

15. A fully functional magnetic holding device of leakage type comprising:

a base having a bottom and a surrounding side wall perpendicular to the bottom, wherein a cavity having an opening at an upper portion thereof is formed by the bottom and the surrounding side wall;

a plurality of source magnets and a non-magnetic conductive material are disposed within the cavity, wherein a holding surface defines the opening at the upper portion of the cavity and the plurality of source magnets are distributed in the cavity whereby lines of magnetic force of the plurality of source magnets is conducted outwards from inside the cavity and through the opening; and a removable leakage type magnetic conductive coverplate covering the holding surface of the magnetic holding device, wherein the leakage type magnetic conductive coverplate is fabricated integrally of a single magnetic conductive material.

16. The magnetic holding device of leakage type of claim 15 further comprising a non-magnetic-conductive material disposed within the cavity and around the plurality of source magnets.

17. The magnetic holding device of leakage type of claim 15, wherein the leakage type magnetic conductive coverplate is fixed to the magnetic holding device with a fastening mechanism.

18. The magnetic holding device of leakage type of claim 17, wherein the fastening mechanism comprises a plurality of screws, a corresponding plurality of threaded orifices formed within the magnetic holding device to receive the plurality of screws, and a frame wall disposed on an edge of the leakage type magnetic conductive coverplate, the frame wall engaging a matching structure on the magnetic holding device to restrain the leakage type magnetic conductive coverplate relative the magnetic holding device.

* * * * *